US011690780B2

(12) United States Patent
Solana et al.

(10) Patent No.: US 11,690,780 B2
(45) Date of Patent: Jul. 4, 2023

(54) VIBRATING MASSAGE ROLLER WITH MULTIPLE MOTORS

(71) Applicant: Therabody, Inc., Los Angeles, CA (US)

(72) Inventors: Jaime Sanchez Solana, Los Angeles, CA (US); Eduardo Merino, Los Angeles, CA (US); Richard Tang, Shenzhen (CN); Jason Wersland, Manhattan Beach, CA (US); Benjamin Nazarian, Los Angeles, CA (US)

(73) Assignee: Therabody, Inc., Los Angeles, CA (US)

( * ) Notice: Subject to any disclaimer, the term of this patent is extended or adjusted under 35 U.S.C. 154(b) by 0 days.

(21) Appl. No.: 17/491,867

(22) Filed: Oct. 1, 2021

(65) Prior Publication Data

US 2022/0015984 A1 Jan. 20, 2022

Related U.S. Application Data

(63) Continuation-in-part of application No. 17/087,851, filed on Nov. 3, 2020.

(60) Provisional application No. 63/086,312, filed on Oct. 1, 2020, provisional application No. 62/983,964, filed on Mar. 2, 2020, provisional application No. 62/930,415, filed on Nov. 4, 2019.

(51) Int. Cl.
*A61H 15/00* (2006.01)
*A61H 23/02* (2006.01)

(52) U.S. Cl.
CPC ..... *A61H 15/0078* (2013.01); *A61H 23/0254* (2013.01); *A61H 2015/0014* (2013.01); *A61H 2201/1215* (2013.01)

(58) Field of Classification Search
CPC ..... A61H 15/0078; A61H 23/0254; A61H 2015/0014; A61H 2201/1215; A61H 1/00; A61H 2201/5064; A61H 2015/0042; A61H 2015/0071; A61H 23/02
USPC ..... 601/57, 63
See application file for complete search history.

(56) References Cited

U.S. PATENT DOCUMENTS 5,413,551 A * 5/1995 Wu ..... A61H 15/00 601/131
5,554,102 A 9/1996 Chiou
(Continued)

FOREIGN PATENT DOCUMENTS

CN 210277532 4/2020
DE 202016104211 9/2016
(Continued)

OTHER PUBLICATIONS

The VIPER by Hyperice: Move Better. Feel Better., Jul. 20, 2014 (https://www.kickstarter.com/projects/74007868/the-vyper-by-hyperice).

(Continued)

*Primary Examiner* — Quang D Thanh
(74) *Attorney, Agent, or Firm* — Sterne, Kessler, Goldstein & Fox P.L.L.C.

(57) ABSTRACT

A massage roller assembly that includes an outer roller surface and a plurality of vibration motors positioned adjacent to the outer roller surface that are configured to transmit vibrations to the outer roller surface. The vibration motors are individually controllable such that at least first and second sets of vibration motors can be switched on and off individually.

16 Claims, 15 Drawing Sheets

(56) References Cited

U.S. PATENT DOCUMENTS

| | | | | |
|---|---|---|---|---|
| 5,637,065 | A | 6/1997 | Chang | |
| 6,432,071 | B1 | 8/2002 | Hsieh | |
| 6,647,572 | B2 | 11/2003 | Lee | |
| 6,832,991 | B1 | 12/2004 | Inada | |
| 6,929,612 | B2 | 8/2005 | Mangano | |
| 7,147,610 | B2 * | 12/2006 | Maalouf | A61H 23/02 601/79 |
| 7,341,566 | B2 | 3/2008 | Nan | |
| 7,510,537 | B2 | 3/2009 | Imboden | |
| 8,500,663 | B2 | 8/2013 | Godfrey | |
| 9,132,055 | B1 | 9/2015 | Wallace | |
| 9,174,079 | B2 | 11/2015 | Berger | |
| 9,192,542 | B2 | 11/2015 | Blenk | |
| 9,968,513 | B1 | 5/2018 | Marton | |
| 10,085,913 | B2 | 10/2018 | Blenk | |
| D837,636 | S | 1/2019 | Wersland | |
| 10,182,962 | B2 | 1/2019 | Godfrey | |
| D845,499 | S | 4/2019 | Wersland | |
| D845,500 | S | 4/2019 | Wersland | |
| D849,260 | S | 5/2019 | Wersland | |
| D849,261 | S | 5/2019 | Wersland | |
| 10,285,901 | B2 | 5/2019 | Godfrey | |
| D850,639 | S | 6/2019 | Wersland | |
| D850,640 | S | 6/2019 | Wersland | |
| 10,449,112 | B2 | 10/2019 | Godfrey | |
| 10,617,588 | B2 | 4/2020 | Wersland | |
| 10,729,614 | B2 | 8/2020 | Marton | |
| 2006/0058713 | A1 * | 3/2006 | Lee | A61H 23/0218 601/78 |
| 2007/0213646 | A1 * | 9/2007 | Han | A47G 9/1045 5/915 |
| 2011/0133910 | A1 * | 6/2011 | Alarcon | G06F 3/011 340/407.1 |
| 2012/0065557 | A1 | 3/2012 | Phillips | |
| 2013/0012848 | A1 | 1/2013 | Forrest | |
| 2013/0281892 | A1 | 10/2013 | Godfrey | |
| 2014/0142478 | A1 * | 5/2014 | Malaviya | A61H 15/0078 601/115 |
| 2015/0148718 | A1 | 5/2015 | Eigler | |
| 2015/0190304 | A1 | 7/2015 | Lawrie | |
| 2016/0113841 | A1 | 4/2016 | Godfrey | |
| 2016/0158096 | A1 | 6/2016 | Godrey | |
| 2017/0216136 | A1 | 8/2017 | Gordon | |
| 2018/0200141 | A1 | 7/2018 | Wersland | |
| 2018/0228689 | A1 | 8/2018 | Lach | |
| 2019/0017528 | A1 | 1/2019 | Wersland | |
| 2020/0261307 | A1 | 8/2020 | Wersland | |
| 2020/0352821 | A1 | 11/2020 | Wersland | |

FOREIGN PATENT DOCUMENTS

| | | | |
|---|---|---|---|
| DE | 202018102706 | | 9/2019 |
| JP | 09140758 | H | 6/1997 |
| KR | 20130032935 | A | 4/2013 |
| WO | 2016153551 | | 9/2016 |
| WO | 2017050525 | A1 | 3/2017 |

OTHER PUBLICATIONS

Vibrating Massage Rod, 2010 (https://www.semanticscholar.org/paper/Vibrating-massage-rod-%E6%9B%BE%E9%9B%AA%E9%B9%8F/1a16b9612a75bc1697e669c6a60d1c0efe82e545).

Einarmmontage, Madeleine Westerholm (https://www.semanticscholar.org/paper/Roller-body-unit-for-a-vibrating-roller-to-Lacken-Rommer/9bd791ac3484c2c9c3cc607cfd146b879b5ee0e1).

Effect of Vibration Foam Rolling and Non Vibration Foam Rolling in the Lower Extremities on Jump Height, Undray Bailey, 2014 (https://dc.ewu.edu/cgi/viewcontent.cgi?article=1258&context=theses).

YouTube, PowerRoll—met diepe massagewerking, Medisana Benelux, Feb. 6, 2015 (https://www.youtube.com/watch?v=XT3pHrSLWn8).

YouTube, Vibration Foam Rolling, PFP media, Dec. 15, 2014 (https://www.youtube.com/watch?v=FfjpbHng5V0).

International Search Report and Written Opinion issued on PCT/US/20/58670.

International Search Report and Written Opinion issued in PCT/US2021/053134.

* cited by examiner

VIBRATING MASSAGE ROLLER WITH MULTIPLE MOTORS

CROSS-REFERENCE TO RELATED APPLICATIONS

This application is a continuation-in-part of U.S. patent application Ser. No. 17/087,851, filed Nov. 3, 2020, which claims the benefit of U.S. Provisional Application No. 62/983,964, filed Mar. 2, 2020 and U.S. Provisional Patent Application No. 62/930,415, filed Nov. 4, 2019, the entireties of which are incorporated by reference herein. This application also claims the benefit of U.S. Provisional Application No. 63/086,312, filed on Oct. 1, 2020, the entirety of which is incorporated by reference herein.

FIELD OF THE INVENTION

The present invention relates generally to a massage roller, and more particularly to a massage roller with multiple motors.

BACKGROUND OF THE INVENTION

Vibrating massage rollers that are typically made of foam are known. For example, see U.S. Patent Publication No. 2016/0113841, the entirety of which is incorporated by reference herein. U.S. Patent App. No. 62/983,964, filed Mar. 2, 2020, U.S. Pat. Nos. 10,449,112 and 5,413,551 are incorporated herein by reference in their entireties. Furthermore, vibrating massage roller are known. The use of vibrating rollers can be noisy because the part of the roller in contact with the ground causes the ground or floor to vibrate, which produces noise.

The background description disclosed anywhere in this patent application includes information that may be useful in understanding the present invention. It is not an admission that any of the information provided herein is prior art or relevant to the presently claimed invention, or that any publication specifically or implicitly referenced is prior art.

SUMMARY OF THE PREFERRED EMBODIMENTS

A massage roller assembly that includes an outer roller surface and a plurality of vibration motors positioned adjacent to the outer roller surface and configured to transmit vibrations to the outer roller surface. The vibration motors are individually controllable such that at least first and second sets of vibration motors can be switched on and off separately. In a preferred embodiment, the outer roller surface defines a central axis, and the vibration motors are arranged circumferentially about the central axis. Preferably, the massage roller assembly includes a main body portion and an outer cover. The main body portion includes a plurality of vibration motor recesses defined therein. Each vibration motor recess includes one of the plurality of vibration motors therein and the outer cover covers the plurality of vibration motors. In a preferred embodiment, the massage roller assembly includes at least a first sensor configured to sense the position of a user on the outer roller surface.

In accordance with another aspect of the present invention there is provided a method of using a massage roller assembly that includes an outer roller surface and a plurality of vibration devices positioned adjacent to the outer roller surface. The plurality of vibration devices form at least first and second sets of vibration devices. The method includes (a) switching on the first set of vibration devices, (b) switching off the first set of vibration devices, and (c) switching on the second set of vibration devices. The steps of the method do not have to be performed in any particular order. The user (or a body part of the user) may be positioned on or against the outer roller surface as at least a portion of the method if performed. In a preferred embodiment, the massage roller assembly defines a horizontal plane that remains horizontal when the massage roller assembly rolls and the method further includes the step of rolling the massage roller assembly from a first position to a second position. During step (a), the first set of vibration devices are located above the horizontal plane and the second set of vibration devices are located below the horizontal plane, and wherein during step (c) the second set of vibration devices are located above the horizontal plane and the first set of vibration devices are located below the horizontal plane. In a preferred embodiment, the massage roller assembly defines a circular shape, wherein the second set of vibration devices are positioned at a location circumferentially offset from the first set of vibration devices. During step (a), at least a portion of the first set of vibration devices are located at 0° (the top) of the massage roller assembly and at least a portion of the second set of vibration devices are located circumferentially offset or at a non-zero angle. And, during step (c) at least a portion of the second set of vibration devices are located at 0° (the top) of the massage roller assembly and at least a portion of the first set of vibration devices are located circumferentially offset or at a non-zero angle.

The present invention includes a method that includes obtaining a vibrating roller that includes a cover and at least first and second vibrating devices. The first vibrating device is configured to vibrate a first portion of an outer surface of the cover, and the second vibrating device is configured to vibrate a second portion of the outer surface of the cover. The method also includes rotating the vibrating roller from a first position where the first vibrating device is activated and the second vibrating device is deactivated and a second position where the second vibrating device is activated and the first vibrating device is deactivated. In a preferred embodiment, in the first position the first vibrating device is directed generally upwardly, and in the second position the second vibrating device is directed generally downwardly and is deactivated.

The present invention includes a vibrating roller, massage roller assembly or vibrating roller assembly that includes a plurality of vibrating devices and a controller. The controller is configured to control the vibrating devices so that during use by a user one or more selected vibrating devices provide vibrations to a treatment portion of an outer surface of the vibrating roller and the remainder of the vibrating devices do not provide vibrations to the remainder or non-treatment portion of the outer surface. In a preferred embodiment, the treatment portion is in the upper portion of the vibrating roller and the non-treatment portion is in the lower portion of the vibrating roller. At least a portion of the lower portion is in contact with the ground during use.

In accordance with an aspect of the present invention there is provided a massage roller assembly that includes a cylindrical main body portion that defines a roller axis and includes an outer roller surface and that includes a plurality of massage members. A plurality of radially extending tunnels are defined in the cylindrical main body portion and through the outer roller surface. The massage members are associated with the cylindrical main body portion and are each configured to reciprocate in a radial direction between a stowed position and a deployed position. In the deployed position at least a portion of the first and second massage members is positioned radially outwardly of the cylindrical main body portion.

In a preferred embodiment, the massage roller assembly includes at least a first motor. The motor rotates a motor shaft and rotation of the motor shaft is converted to reciprocating motion to reciprocate the massage members between the stowed and deployed positions. Preferably, the massage roller assembly includes a plurality of push rod assemblies that each include a distal end and each of the massage members are located at the distal ends of the push rod assemblies. In a preferred embodiment, the motor shaft rotates a counterweight that is operatively connected to or operatively associated with at least one of the push rod assemblies.

In a preferred embodiment, the rotating shaft is a cam shaft that includes at least a first cam path that moves at least a first massage member of the plurality of massage members between the stowed and deployed positions. Preferably, the massage members are biased to the stowed position via a spring, biasing member or the like.

In a preferred embodiment, the massage roller assembly includes an outer cover that at least partially surrounds the cylindrical main body portion and the massage members deflect the outer cover when moving from the stowed position to the deployed position. In a preferred embodiment, the outer cover includes a plurality of massage protrusions that each define a protrusion interior and the massage members move radially outwardly into the protrusion interiors of the massage protrusions when moving to the deployed position (they can deflect the outer wall of the massage protrusion or just move into the protrusion interior space without touching and/or deflecting the outer wall.

In a preferred embodiment, the plurality of tunnels each include a massage member recess (the massage member recess may be the same diameter or have the same width dimension as the remainder of the tunnel). The outer surface defines an outer surface extended that extends over the massage members recesses. In the stowed position the massage members are positioned radially inwardly of the outer surface extended.

In a preferred embodiment, the massage roller assembly includes a controller that controls the reciprocation of the massage members. Preferably, the plurality of massage members comprises at least a first set and a second set and the controller is configured to reciprocate the first set separately from the second set. A set can be any number of different massage members, including a single massage member. For example, a set can be a row, a portion of a row, a ring or column or a portion of a ring or column, a quadrant, a half, a pair, etc. In a preferred embodiment, the controller is configured to move the first massage member to the stowed position and then remain in the stowed position, thereby providing a protrusion for a user to "roll" on to affect a desired body part.

Generally, the present invention includes a plurality of reciprocating massage members that are selectively reciprocated outwardly to provide an undulating surface that can provide therapy, massage or the like to a user of the roller. In a preferred embodiment, the massage members are reciprocated radially outwardly, as shown in the drawings. The massage members can each be located at the distal end of a push rod assembly that is driven by a motor. The drive train can be similar to that of a percussive massage or therapy device, as taught in U.S. Patent Publication. No. 2020/0352821 and U.S. Patent Publication No. 2020/0261307, the entireties of which are incorporated by reference herein. One or more motors reciprocate the massage members. The motors may provide rotational motion via a shaft that is converted to reciprocating motion, for example, via one or more cam shafts, one or more crank shafts, counterweights, gearing, etc. The rotational motion can be converted to reciprocal motion of a rod or push rod that includes one or more massage members of protruding members on the distal end thereof. In another embodiment the motors can directly provide the reciprocating motion.

Different sets of massage members can be reciprocated outwardly at different times. For example a row or line of massage members can all reciprocate outwardly together or a section that includes a portion of a row and a portion of a ring of massage members can all reciprocate outwardly together.

In a preferred embodiment, the massage roller assembly includes an outer cover. The outer cover can include massage protrusions into which the massage members reciprocate. In this embodiment, the massage members essentially enter the protrusion interior so that a user feels the massage member through the outer cover when using the device. The massage members can be completely radially inward of the outer roller surface extended (i.e., if the outer roller surface extended over the outer opening of the radially extending tunnels) in the stowed or starting position and then extend at least partially outside of the radially extending tunnels (or the massage member recess portions thereof). In another embodiment, the massage members can extend at least partially outside of the outer roller surface extended in the stowed or starting position and then extends at least partially further outside of the radially extending tunnel. In another embodiment, the massage protrusions can be omitted and the massage members can deflect or stretch the outer cover when they move to the deployed position.

In another preferred embodiment, the outer cover is omitted and the massage members can operate as described in the above paragraph. In either embodiment, the massage members can be removable or interchangeable and replaced with other or different massage members. In the embodiment that includes the outer cover, but where the massage members are removable, the outer cover can be removable. Or, the massage protrusions can be removable or openable to access the massage members and remove and replace them. In another embodiment, the massage members can be permanent.

The present invention is a massage roller assembly, undulating massage roller or vibrating massage roller. In a preferred embodiment, the massage roller assembly includes a cylindrical main body portion with a plurality of massage members or massage attachments protruding away from the external surface of the main body portion. In a preferred embodiment, the massage members are shaped similarly to at least some of the massage attachments shown in the design patents that are incorporated by reference above. The massage members can also take shapes. A single type or shaped massage member can be used throughout the entire cylinder or roller. In another embodiment more than one type or shaped massage member can be used. As a result, the outside or contact surface (the surface that contacts a user) is comprised of the distal ends of the massage members.

In a preferred embodiment, the vibrating or massage roller assembly includes different portions, sections or quadrants of the exterior of the cylinder. A different type of massage member can be used in each quadrant. For example, the first quadrant can include a set of dampener massage members, the second quadrant can include a set of small ball massage members, the third quadrant can include a set of wedge massage members, and the fourth quadrant can include a set of cone massage members. The massage members can be permanently affixed to the main body portion (e.g., on posts or the like) or can include an attachment system that provides the ability to remove and replace massage members. For example, any of the attachment systems taught in U.S. Patent Publication No. 2019/0017528 and D837636, the entireties of which are incorporated herein by reference, can be used.

The massage members can all vibrate, reciprocate or move at the same amplitude and frequency or some can operate at a different amplitude and frequency than others. Furthermore, the massage members can move in synchrony or can move in alternating type patterns. For example, a set of axially spaced massage members can move up and down (or in and out, with respect to the main body portion) in a wave pattern. A row or a portion of a row can reciprocate at the same time or ring or a portion of a ring can reciprocate at the same time.

In a preferred embodiment, the vibrating roller assembly includes one or more internal motor(s) or other device(s) that provides vibration to the external surface thereof or reciprocates the massage members. In a preferred embodiment, the massage roller assembly includes buttons and a display screen (can be a touch screen) on an end thereof for stopping, starting, activating, etc. The screen can also include other functions. The device can include other controllers, such as a thumbwheel or rolling button positioned near the touch screen/on off button to allow the user to scroll or navigate through the different functions.

In a preferred embodiment, the massage roller assembly includes a touch screen, a center button, for turning the device on and off and a ring/rocker button that provides the ability to scroll left and right (e.g., to the preset treatments discussed herein) and up and down (e.g., to control the speed, amplitude or frequency). The screen can also be a non-touch screen.

In a preferred embodiment, the massage roller assembly includes a wireless charging assembly or capability that provides the ability to charge the battery without plugging the battery or the device into anything. Preferably, the massage roller assembly can be received in a charging device or stand, e.g., in a vertical orientation. The charging transmitted is located in the stand and the charging receiver is located in the end of the massage roller.

In another embodiment, the vibrating roller assembly includes a cylindrical main body portion, core or shell housing halves, a motor, a PCB panel, a counterweight, a wireless charger assembly (receiver), an end cap, an on/off button and speed buttons that allow the frequency or speed of the vibrations (based on the speed of the motor/counterweight) to be raised or lowered (e.g., five different speeds). The core housing halves define a housing interior where the motor and counterweight are housed. The motor rotates the counterweight, which causes the housing and cylindrical main body portion to vibrate.

In another preferred embodiment, the massage roller assembly includes massage members are contained within an outer membrane or cover. The massage members reciprocate or move inwardly and outwardly (i.e., in a radial direction) and push against the membrane to provide a massage against the user.

In a preferred embodiment, any of the massage roller assemblies discussed herein can be associated with and can be operated by an app or software that runs on a mobile device such as a phone, watch or tablet (or any computer). The app can connect to the massage roller assembly via bluetooth or other connection protocol. For example, for the massage roller assembly can include bluetooth capability in the PCB panel. The app can have any or all of the following functions. Furthermore, any of the functions discussed herein can be added to the touch screen/scroll wheel or button(s) capability directly on the device. If the user walks or is located too far away from the device, the device will not work or activate. The device can be turned on an off using the app as well as the touch screen or button on the device. The app can control the variable speeds (speed or frequency of vibration in vibrating massage roller) or amplitude/stroke (e.g., of any of the massage members). A timer so the device stops after a predetermined period of time. The app can also include different treatment protocols associated therewith. This will allow the user to choose a protocol or area of the body they want to work on. When the start of the protocol is selected, the device will run through a routine. For example, the device may run at a first RPM for a first period of time and then run at a second RPM for a second period of time and/or at a first amplitude for a first period of time and then run at a second amplitude for a second period of time. The routines can also include prompts (e.g., haptic feedback) for letting the user to know to move to a new body part. These routines or treatments can be related to recovery, blood flow increase, performance, etc. and can each include a preprogrammed routine. The routines can also prompt or instruct the user to switch massage members or switch to a different quadrant or area of the device that includes different massage members than are currently being used. The prompts can include sounds, haptic feedback (e.g., vibration of the device or mobile device), textual instructions on the app or touch screen, etc. For example, the app may instruct the user to start by rolling on the device in quadrant one. Then the user hits start and the device runs at a first frequency for a predetermined amount of time. The app or device then prompts the user to begin the next step in the routine and instructs the user to change to rolling in quadrant two. The protocols can include control of or prompts for the user to control or change speed/frequency, amplitude, time, on/off, temperature (if the vibrating roller assembly, or outer surface thereof, is heated), force, massage member used.

In a preferred embodiment, the app includes near field communication ("NFC") capability or other capability that allows the user's mobile device with the app thereon to scan an identifier, such as a barcode or a QR code that prompts the app to display certain information, such as the routines discussed above. In use, a user will be able to tap or place their mobile device near an NFC tag (or scan a QR code) on a piece of gym equipment and the app will show instructions, content or a lesson that is customized for using the massage roller assembly with that piece of equipment. For example, on a treadmill, the user scans the QR code or NFC tag and the app recognizes that the user is about to use the treadmill. The app can then provide instructions for how to use the device in conjunction with the treadmill and can initiate a preprogrammed routine for using the treadmill. For example, the user can be instructed to start with the left quad. Then, after a predetermined period of time (e.g., 15 seconds), the massage roller assembly vibrates or provides other haptic feedback. The user then switches to their left quad and after a predetermined period of time the device again vibrates. The user can then begin using the treadmill. Any routine is within the scope of the present invention. In an embodiment, the device and/or app (i.e., the mobile device containing the app) can also communicate (via bluetooth or the like) with the gym equipment (e.g., treadmill).

The device can also include a torque or force meter to let the user know how much force they are applying and shows how much force is being applied on the muscle. In a preferred embodiment, the device includes a torque measuring sensor and display. Depending on the muscle the device is being used on and the benefit the user is looking to get (prepare, perform, recover) the force that should be applied varies. By having a force sensor, the user will be able to get a more precise and personalized treatment. The app and the touchscreen can provide the force information to the user. The force meter can be integrated with the routines and the user can be provided feedback with whether they are applying too much or too little pressure. The device can also include a thermal sensor or thermometer that can determine the temperature of the user's muscle and to provide feedback to the device and/or app. The haptic feedback can also provide feedback for too much pressure or force. The force meter can provide feedback to the user based on how much weight is being placed on the device (since a foam roller works based on a user placing their body weight on the device) and can notify the user (via sounds, haptic feedback, lights, etc.) whether to place more or less weight on the device or portion of the device.

The battery may be any type of battery known in the art. For example, the battery may include a rechargeable lithium-ion (LiIon) based battery. In another example, the battery may include a rechargeable nickel metal hydride (NiMH) battery. In yet another example, the battery may include a rechargeable lithium-polymer (LiPo) battery. In some embodiments, the battery includes a nickel-cadmium (NiCad) battery. In one embodiment, the battery uses a non-rechargeable battery.

The present invention is a vibrating roller assembly that includes multiple motors. Vibrating massage balls and vibrating "peanut shaped" rollers, as well as cylindrical rollers are known (all referred to herein together as "vibrating rollers," "massage rollers," "vibrating roller assemblies" or "massage roller assemblies"). A vibrating roller that includes multiple motors or vibration devices (referred to herein as "vibration devices") that are distributed throughout the surface (or close/adjacent to the surface) of the vibrating roller and that allow the vibrating devices on the lower half (or other portion) of the device or those that are not in contact with or providing direct vibration to the user's body to selectively turn off during use in order to prevent the portion of the vibrating roller in contact with the ground from vibrating. Some vibration of the lower portion in contact with the ground may be caused by the vibration devices that are still on (i.e., those on the upper portion), but the vibration between the vibrating roller and the floor should be less than if the lower portion vibrating devices were on.

The multiple vibrating devices can also provide the ability to strategically vibrate only a portion of the surface or surface area of the outside of the vibrating roller for reasons other than preventing vibration on the floor. For example, the vibrating roller can include controls to only activate a portion of the vibrating roller or of the outer surface area of the vibrating roller (e.g., only a portion of the device in a longitudinal direction, a quadrant, etc.). In another embodiment, sensors can be provided that sense or determine where a user is applying pressure and only activate vibration in the specific area being utilized. Furthermore, the vibrating device can be controlled such that different intensities of vibration can be provided at different times or in different portions of the roller. Turning vibration devices on and off at different times also helps save the battery of the device because less than a full amount of all the vibration devices or motors are vibrating or on at any one time.

In a preferred embodiment, the vibrating roller assembly may include an inner shell with a plurality of motor or vibrating device recesses and fastener recesses defined therein that are configured to receive vibrating devices and associated fasteners, e.g., screws, respectively. The inner shell may include wire openings defined therein for directing wires into the interior of the inner shell. One or more batteries, controllers (for controlling the vibrating devices and turning them on and off as desired), printed circuit boards and other components can be housed inside the inner shell and a cover (e.g., a foam cover) can be placed over the inner shell for a user to roll on. In a preferred embodiment, all of the vibration motors or devices or arranged circumferentially about the central axis (or the center—in the case of a sphere) and there are no vibration motors or devices located along the central axis.

Any method for determining when to turn the desired motors on and off is within the scope of the present invention. For example, proximity sensors (that sense when the subject portion of the vibrating roller is proximate to the user or the floor) can be used. Another embodiment can embody the idea of a compass where the needle always points north. In this embodiment, a component that always points or is directed up or down can be utilized. For example, the vibrating roller can include a hanging weight, mass or the like that can be disposed inside the inner shell. During rolling, due to gravity, the weight remains in the lower portion of the vibrating roller (i.e., it always "points" or hangs downwardly). As a result, it can be determined what portion of the vibrating roller is facing upwardly (and can be utilized by a person for rolling thereon) and what portion of the vibrating roller is facing downwardly. In turn, as the vibrating roller is rotated and used, the vibrating devices in the lower portion or section of the roller are switched off. Magnets or other types of sensors can be used to sense when the weight is in the lower half or keep the device in the lower portion, thus switching off the vibrating devices in the lower portion and switching on the vibrating devices in the upper portion at the desired time.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
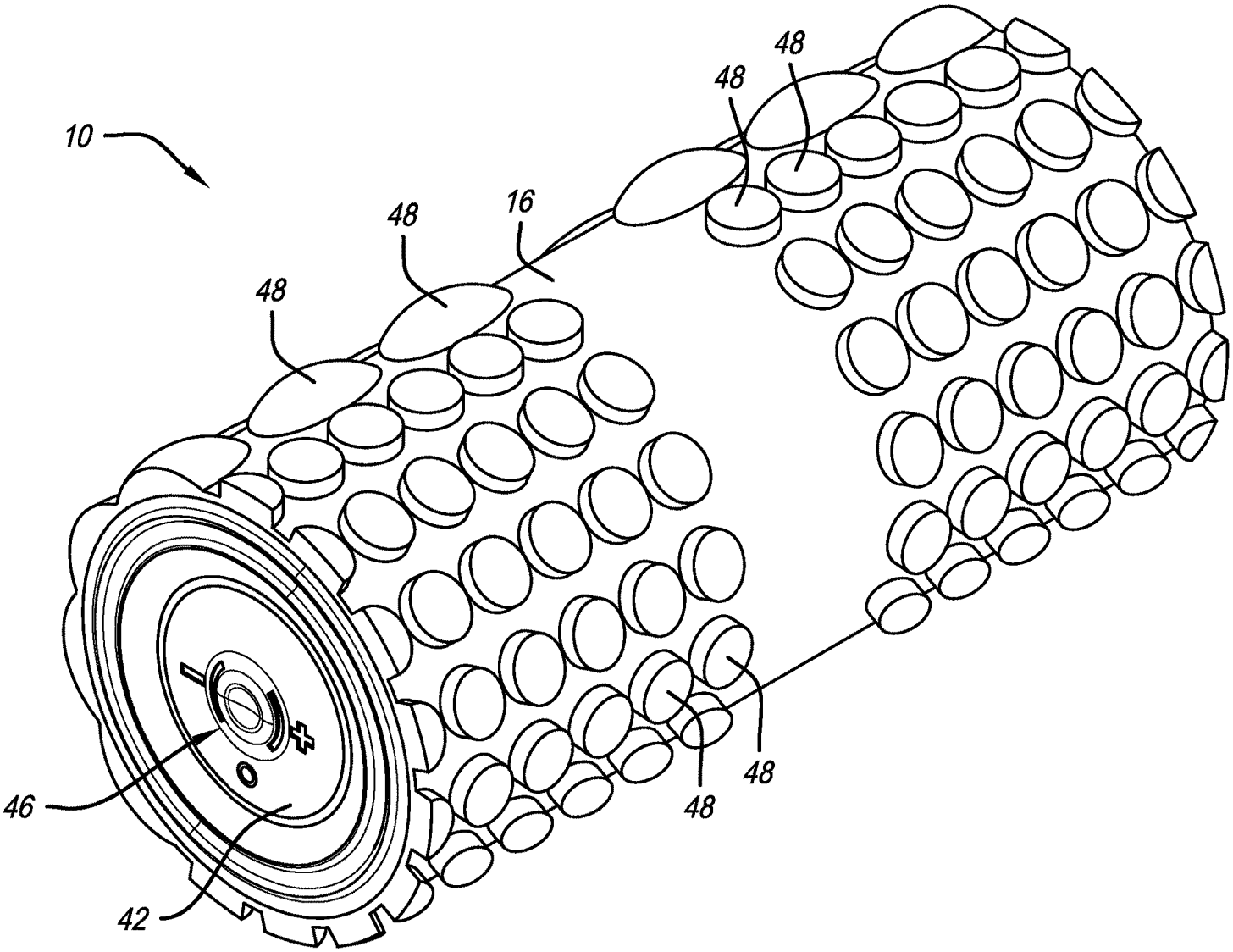
FIG. 1 is a perspective view of a massage roller assembly in accordance with a preferred embodiment of the present invention.

The following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but not necessarily are references to the same embodiment; and, such references mean at least one of the embodiments. If a component is not shown in a drawing then this provides support for a negative limitation in the claims stating that that component is "not" present. However, the above statement is not limiting and in another embodiment, the missing component can be included in a claimed embodiment.

Reference in this specification to "one embodiment," "an embodiment," "a preferred embodiment" or any other phrase mentioning the word "embodiment" means that a particular feature, structure, or characteristic described in connection with the embodiment is included in at least one embodiment of the-disclosure and also means that any particular feature, structure, or characteristic described in connection with one embodiment can be included in any embodiment or can be omitted or excluded from any embodiment. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others and may be omitted from any embodiment. Furthermore, any particular feature, structure, or characteristic described herein may be optional. Similarly, various requirements are described which may be requirements for some embodiments but not other embodiments. Where appropriate any of the features discussed herein in relation to one aspect or embodiment of the invention may be applied to another aspect or embodiment of the invention. Similarly, where appropriate any of the features discussed herein in relation to one aspect or embodiment of the invention may be optional with respect to and/or omitted from that aspect or embodiment of the invention or any other aspect or embodiment of the invention discussed or disclosed herein.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted.

It will be appreciated that the same thing can be said in more than one way. Consequently, alternative language and synonyms may be used for any one or more of the terms discussed herein. No special significance is to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," "aft," "forward," "inboard," "outboard" and "below" used herein are merely for ease of description and refer to the orientation of the components as shown in the figures. It should be understood that any orientation of the components described herein is within the scope of the present invention.

Figure 2:
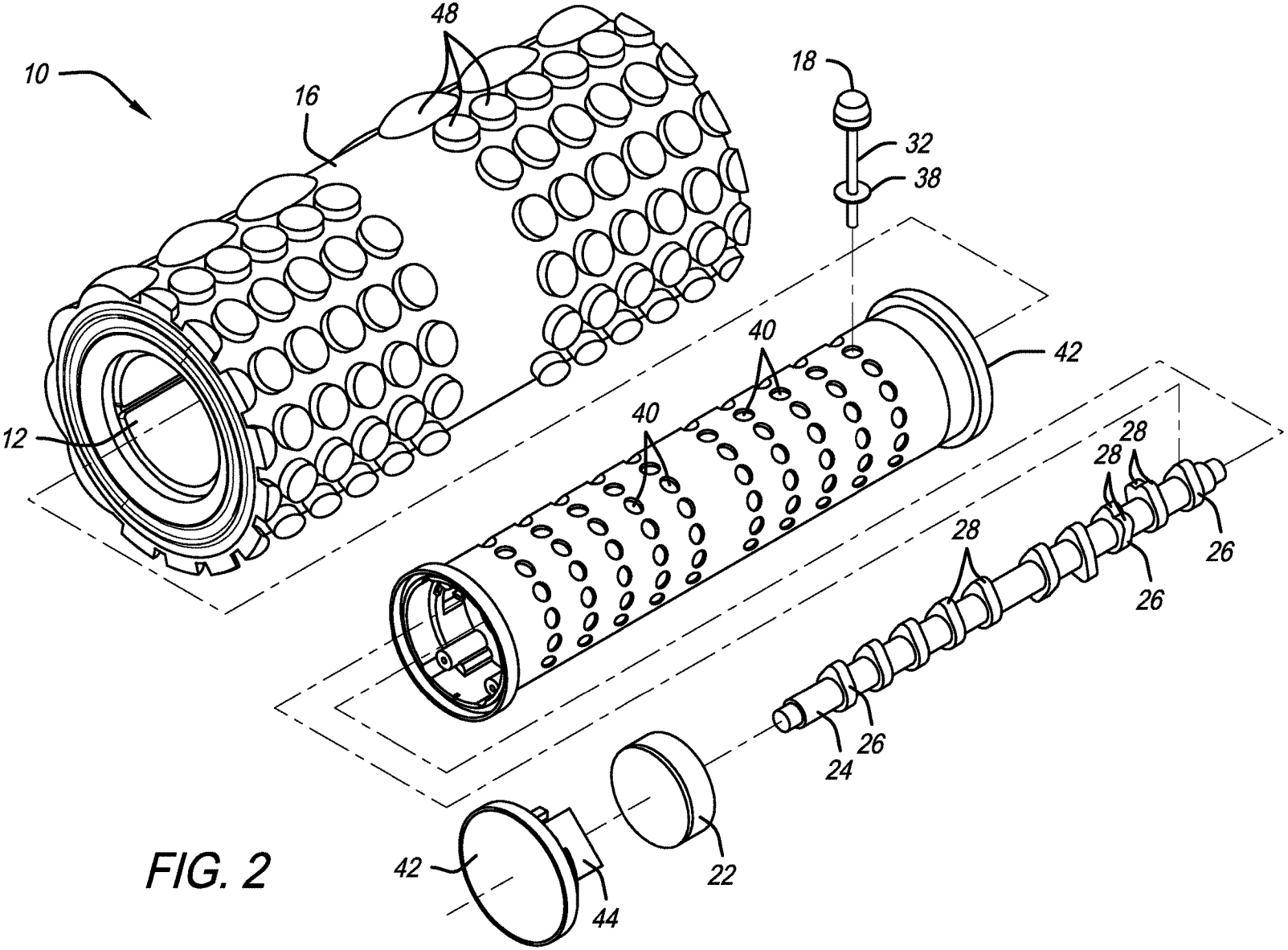
FIG. 2 is an exploded perspective view of the massage roller assembly.
Figure 3:
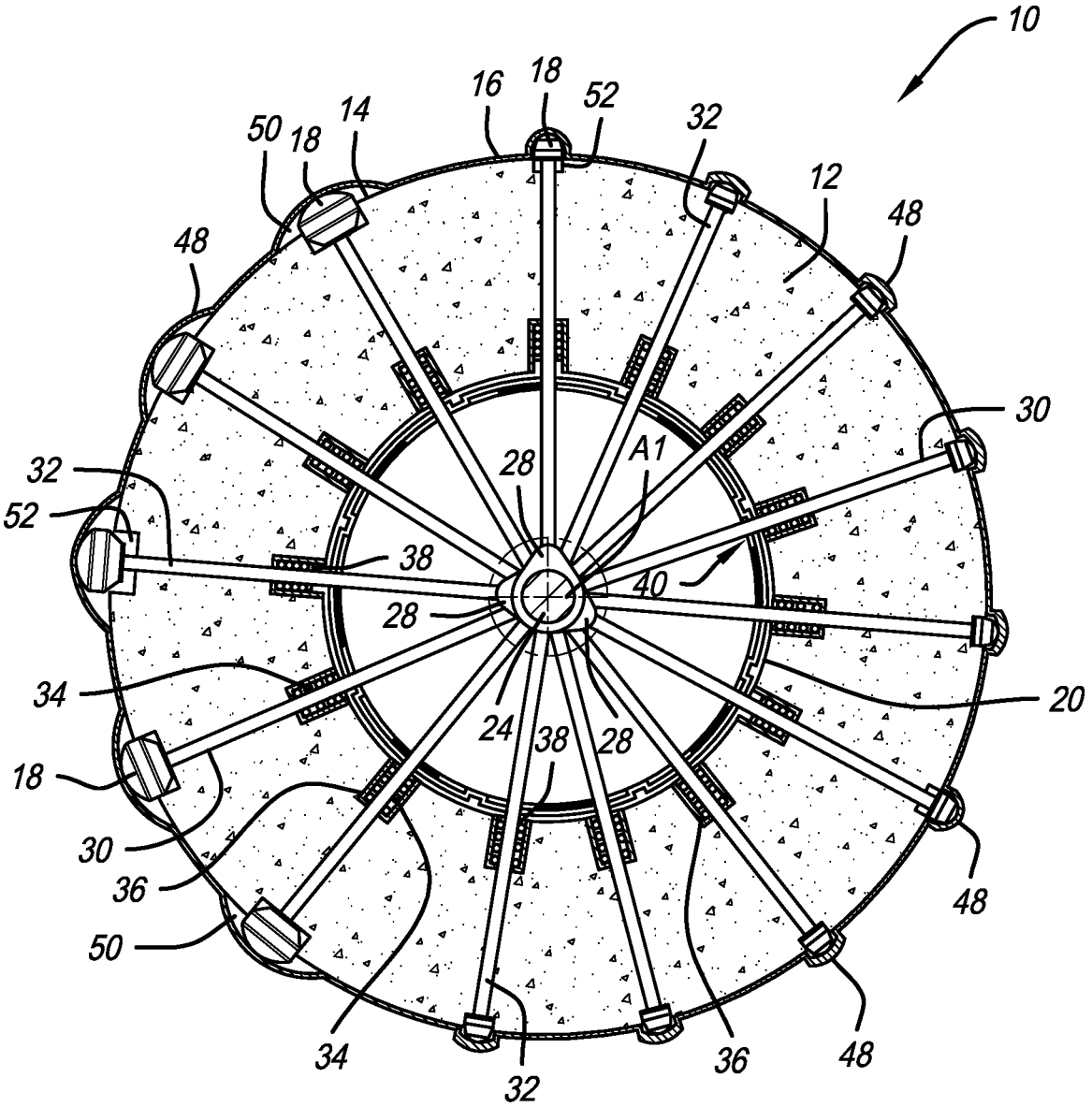
FIG. 3 is a cross-sectional end view of the massage roller assembly.

Referring now to the drawings, which are for purposes of illustrating the present invention and not for purposes of limiting the same, the drawings show a massage roller assembly 10 that includes an undulating outer surface. As shown in FIGS. 1-3, the massage roller assembly 10 generally includes a cylindrical main body portion 12 that defines a roller axis A1 and includes an outer roller surface 14, an outer cover 16 and a plurality of reciprocating massage members 18. The outer roller surface 14 of the cylindrical main body portion 12 is not necessarily the surface used for contact with a user. As shown in FIG. 3, the outer roller surface 14 is inside the outer cover 16. However, in the embodiment shown in FIG. 4, the outer cover is omitted.

In a preferred embodiment, the massage roller assembly 10 includes an inner shell 20 that may include separate halves or portions. The inner shell 20 preferably houses the motor(s) 22 and one or more batteries. In a preferred embodiment, the motor 22 rotates a motor shaft and the rotational motion is converted to reciprocating motion to reciprocate one or more of the massage members 18 between the stowed and deployed positions. As shown in FIG. 2, in a preferred embodiment, the massage roller assembly 10 includes a cam shaft 24 that is co-axial with the roller axis A1. The cam shaft 24 includes a plurality of cam paths 26 that include one or more lobes 28 thereon.

Figure 4:
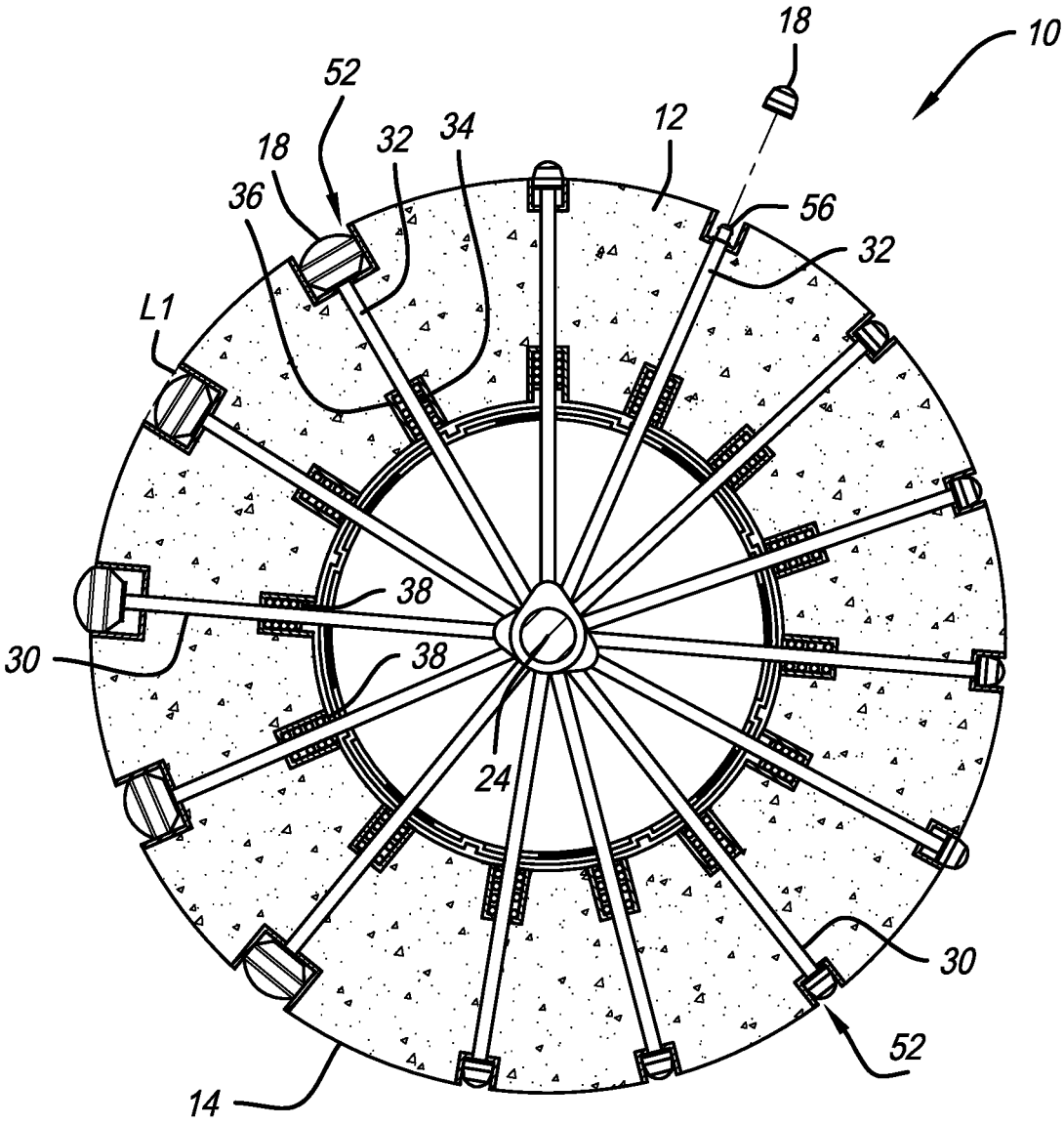
FIG. 4 is a cross-sectional end view of a massage roller assembly in accordance with another embodiment of the present invention.

As shown in FIGS. 3-4, in a preferred embodiment, a plurality of radially extending tunnels 30 are defined in the cylindrical main body portion 12. A plurality of push rod assemblies 32 extend radially outwardly through tunnels 30. It will be appreciated that the term push rod assembly does not necessarily mean that the push rod assembly has more than one component. A single rod can be considered a push rod assembly. As is discussed herein, a number of different push rod assemblies can be part of the drive train that converts the rotational motion of the motor and motor shaft to reciprocating motion of the massage member. The push rod assemblies can cause the massage members 18 to have any desired amplitude or stroke. For example, the amplitude of reciprocation of a massage member between the stowed and the deployed position can be any number between 1 mm and 100 mm. The amplitude can also be adjustable, which can change the strength of the treatment provided to the user.

In the embodiment shown in FIGS. 2-4, the push rod assemblies 32 include the massage members 18 on the distal end thereof. The proximal end of the push rod assemblies 32 are operatively connected to or ride along one of the cam paths 26 (see FIG. 3). In use, as the cam shaft 24 rotates, as the proximal end of a push rod assembly 32 rides over a cam lobe 28 the massage member 18 on the distal end of the push rod assembly 32 moves radially outwardly from the stowed position to the deployed position.

The cam shaft 24 in FIG. 2 shows a number of different lobe combinations. This is shown to illustrate that one or more lobes can be located along a single cam path. It will be appreciated that the cam shaft (or multiple cam shafts) can be constructed so that it the massage members 18 are reciprocating outwardly in any number of different patterns. FIG. 2 also only shows a single push rod assembly 32 and massage member 18 to prevent the exploded view from being too cluttered.

The push rod assemblies 32 are biased inwardly toward and/or against the cam paths so that the massage members 18 remain or are normally in the stowed position. Any method or components for biasing the push rod assemblies 32 is within the scope of the present invention. As shown in FIGS. 3-4, in a preferred embodiment, the massage roller assembly 10 includes a plurality of springs 34 positioned along the tunnels 30 that bias the push rod assemblies 32 radially inwardly. The springs 34 are housed in spring recesses 36 that are a part of the tunnels 30. In a preferred embodiment, the push rod assemblies 32 include a flange or disc 38 that the springs 34 push against to provide the bias. The springs also push against an end of the spring recess.

As shown in FIGS. 2-4, in a preferred embodiment, the inner shell 20 includes a plurality of rod holes 40 defined therein through which the push rod assemblies 32 extend and that align with the tunnels 30. The massage roller assembly 10 includes end caps 42 that cap or cover the ends of the inner shell 20. The end caps 42 can house some or all of the electronics of the massage roller assembly. For example, the PCB 44 can be included on one of the end caps 42. FIG. 1 shows exemplary control buttons 46 that can be used in the control of the massage roller assembly 10.

As shown in FIG. 1, in a preferred embodiment, the outer cover 16 includes a plurality of massage protrusions 48. The massage protrusions 48 define a protrusion interior 50 into which the massage members 18 reciprocate and/or are housed. In the embodiment shown in FIG. 3, in the stowed position, the massage members 18 are partially housed in massage member recesses 52 and partially housed in the massage protrusions 48. As shown in FIG. 3, as the massage members 18 move to the deployed position they push against and deflect or stretch the outer cover 16 and the associated massage protrusion 48 (see, e.g., the massage member 18 at the top of FIG. 3). In another embodiment, the massage members 18 may not push against the massage protrusion 48, but instead are reciprocated into the protrusion interior 50 (or further therein such that they take up more of the volume thereof). The point is for the massage member 18 to move outwardly so that it pushes against a user that is using the roller.

In the embodiment of FIG. 4, where the outer cover is omitted, the massage members 18 are housed completely within the massage members recesses 52 and extend at least partially outside of the massage members recess 52 when deployed. When the massage members 18 are completely with in the massage member recesses 52 (or tunnels 30), the outer roller surface is essentially smooth. In other words, if the outer roller surface extended over the massage member recesses 52 ("the outer roller surface extended"), the outer roller surface extended would not extend through any of the massage members. Instead the massage members are positioned radially inward of the outer roller surface extended. In the deployed position, the massage members 18 extend through the outer roller surface extended and outside of the massage member recesses 52 and the tunnels 30. See the "outer roller surface extended" in FIG. 4 represented by dashed line L1. In another embodiment, the massage members can include an outer surface that, when the massage member is positioned in the massage member recess, is substantially flush with the outer roller surface. In other words, when the massage members are in the stowed position the outer roller surface looks and feels smooth. Then, when the massage members move to the deployed position, they reciprocate outwardly from or with respect to the outer roller surface.

Figure 5:
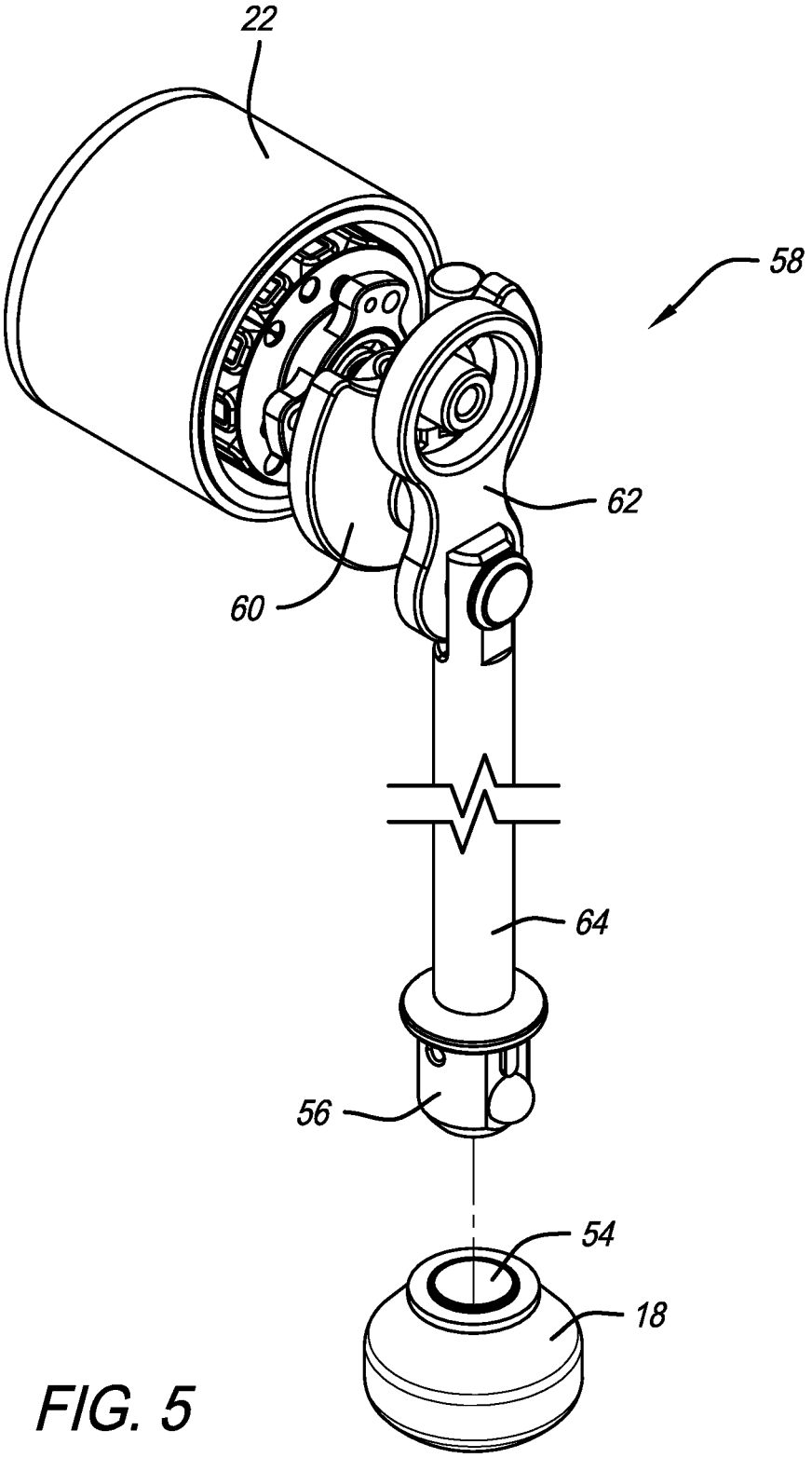
FIG. 5 is perspective view of a drive train.

As shown in FIG. 4 by the massage member 18 that is exploded from the distal end of the push rod assembly 32, the massage members can be removable so that they can be replaced by different massage members. This can change the strength or severity of the treatment provided by the massage roller. Any type of connection between the massage members and the distal ends of the push rod assemblies is within the scope of the present invention. As shown in FIG. 5, the massage member 18 can include a female connection member 54 and the push rod assembly 32 can include a male connection member 56 (see U.S. Pat. No. 10,617,588, the entirety of which is incorporated by reference in its entirety). In another embodiment, the massage member can include a male connection member and a female connection member can be included on the roller (or on the distal end of the push rod). If the same type of attachment system is used on the massage roller assembly 10 as the percussive therapy devices taught in the documents referenced herein the massage members can be advantageously swapped back and forth between the different devices.

FIG. 5 shows a type of drive train 58 that can be used in the massage roller assembly of the present invention. The drive train 58 includes a brushless motor 22, counterweight 60, and push rod assembly 32, which includes reciprocating shaft 62, push rod 64 and male connection member 56 on the distal end thereof. The motor 22 can drive one or more push rod assemblies 32 and massage members 18. The massage roller assembly 10 can include multiple drive trains 58 or portions thereof including a single drive train for each massage member.

Figure 6:
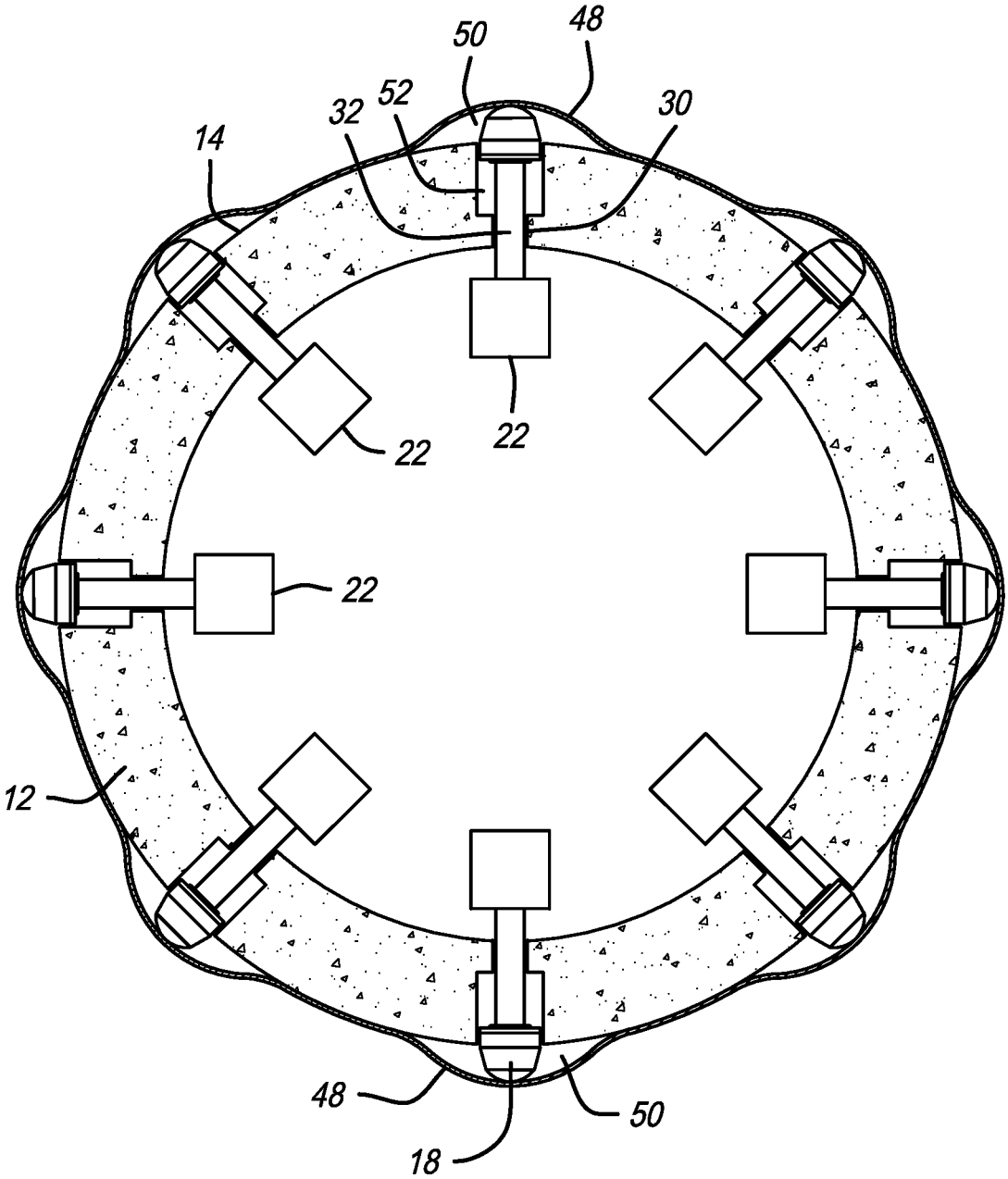
FIG. 6 is a cross-sectional end view of an embodiment of a massage roller assembly.

FIG. 6 shows another embodiment of the massage roller assembly 10 that includes a plurality of motors 22 distributed in a generally circular or round pattern throughout the interior of the cylindrical main body portion 12 that drive or reciprocate one or more massage members 18. The motors in this embodiment push and pull or reciprocate the push rod assemblies 32 and the massage members 18. In another embodiment, a plurality of rotating cam or crank shafts can be distributed in a generally circular or round array or pattern (e.g., in the same positions as the motors 22 in FIG. 6). In this embodiment, each rotating shaft is rotated by a motor and can operate one or more rows of massage members.

Figure 7:
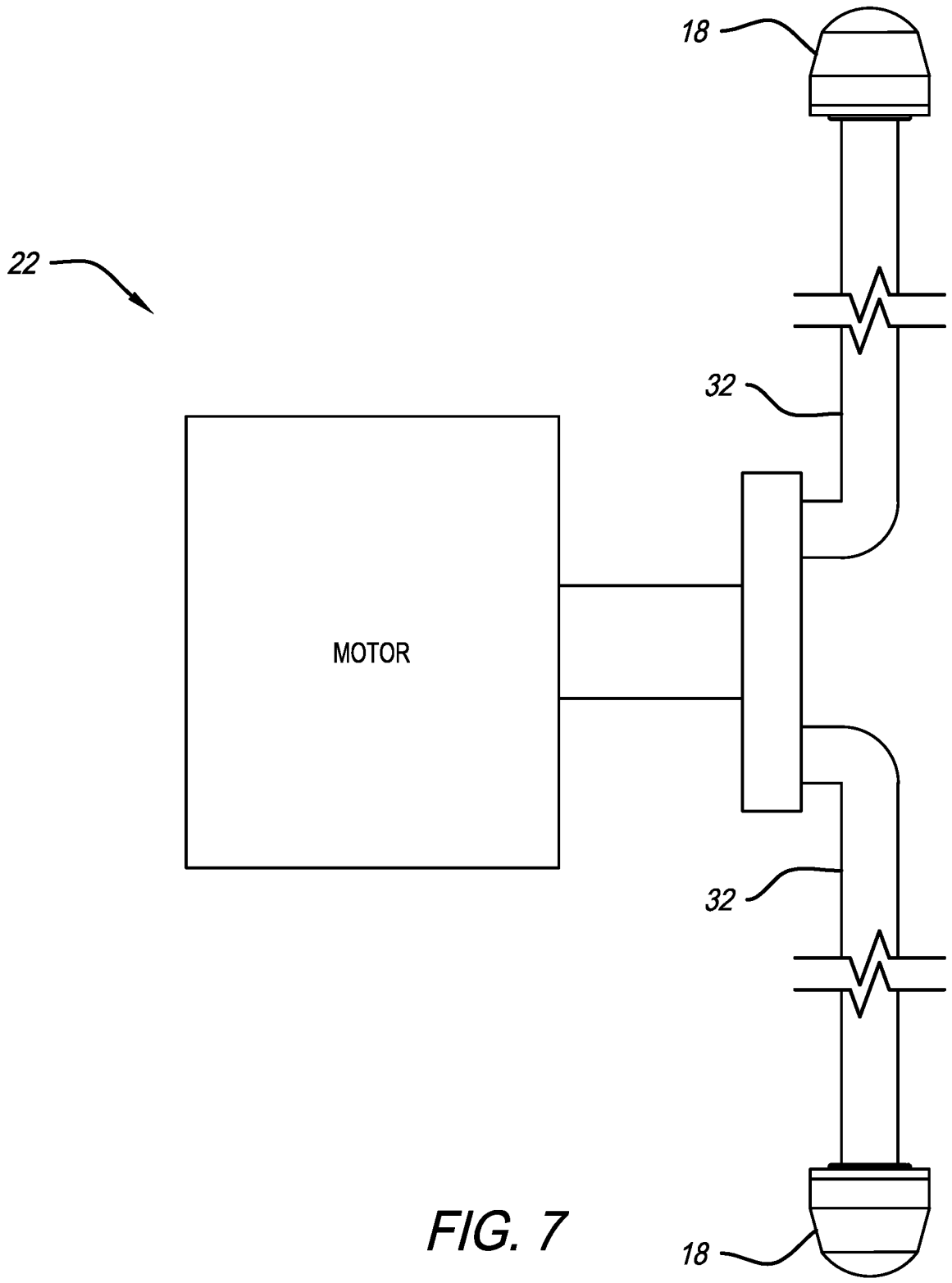
FIG. 7 is a schematic of a motor reciprocating two push rods.
Figure 8:
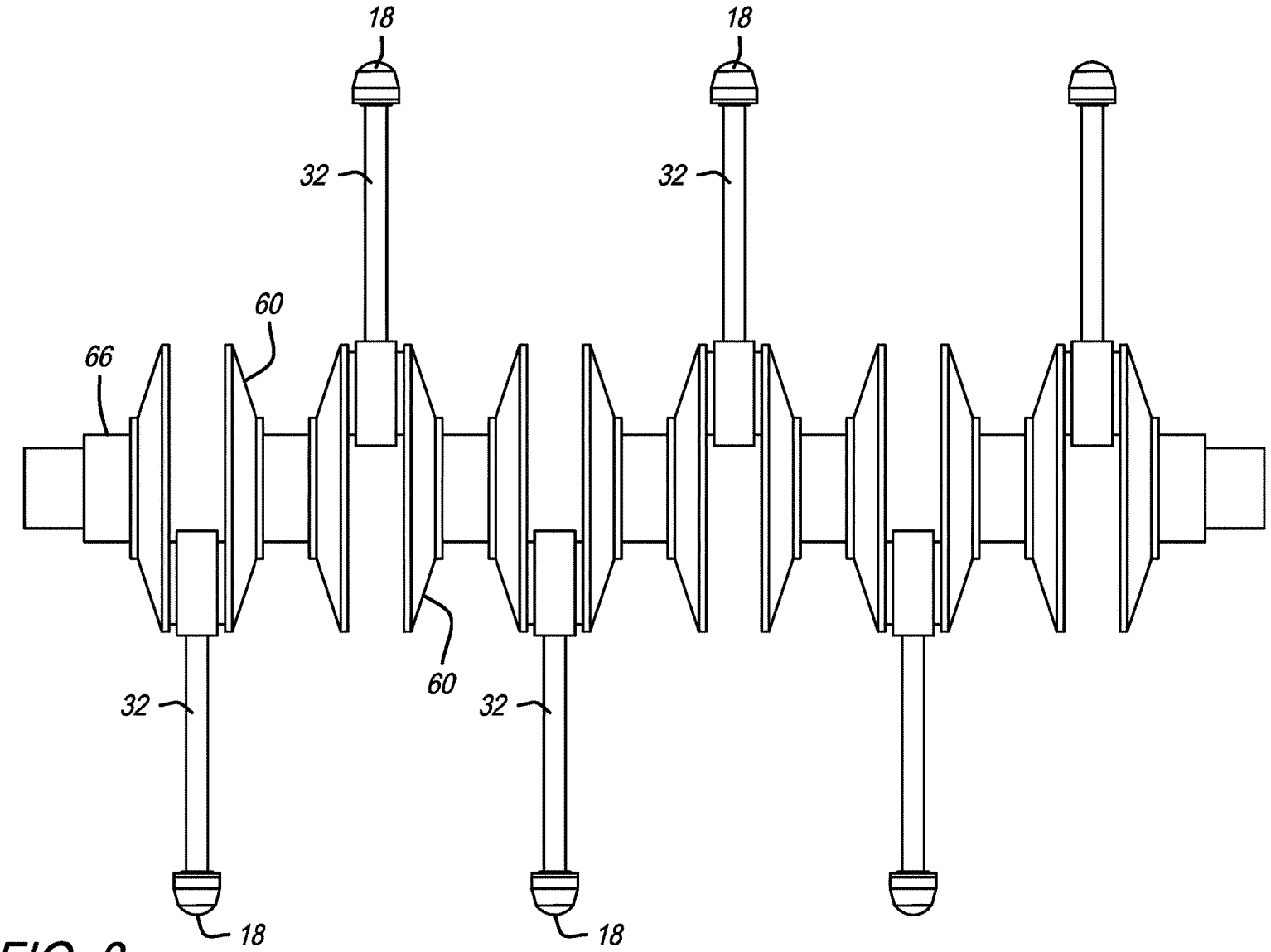
FIG. 8 is a crank shaft that includes a plurality of push rods and massage members extending therefrom.

FIG. 7 shows an embodiment where a single motor operates oppositely extending push rod assemblies 32 and massage members 18. FIG. 8 shows an exemplary crank shaft 66 that can be used to reciprocate a plurality of push rod assemblies 32 and massage members 18.

In a preferred embodiment, the massage roller assembly includes a controller that controls the motor(s) and/or the reciprocation of the massage members. For example, the controller can be a part of the PCB 44. The controller can include programming to provide different patterns of reciprocation of the various massage members. The controller can control such aspects as the stroke of the massage members and the speed or frequency of the reciprocation of the massage members. In a preferred embodiment, the massage members can be reciprocated outwardly and then stopped in the deployed or outward position to provide a peak or raised area that can be used for a user to "roll" thereon. For example, the user may place their hip flexor on the peak to treat that area based on their body weight and how it is generally understood that a massage or foam roller is used. This can be operated, for example, by a pause button.

Figure 11:
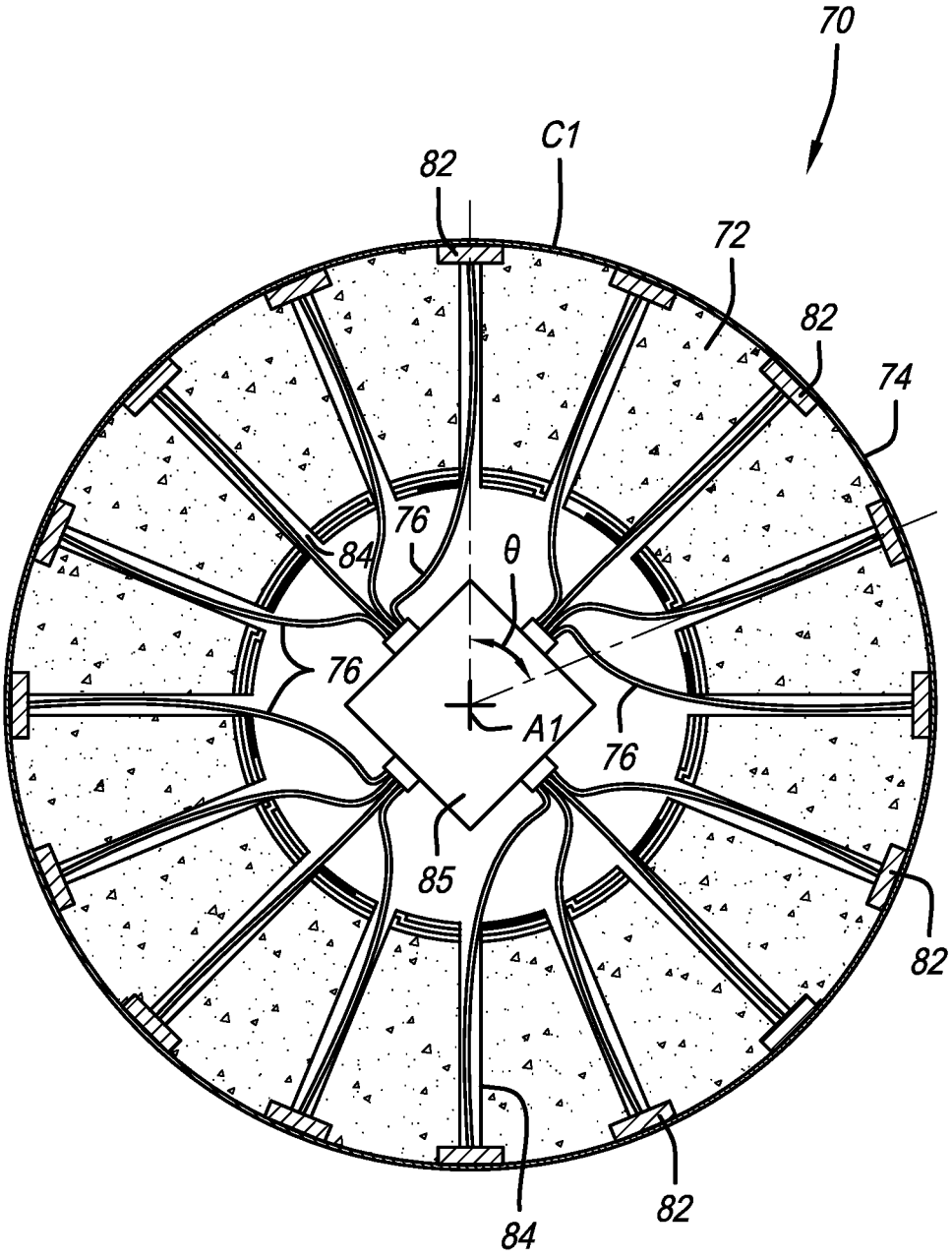
FIG. 11 is a cross-sectional end view of the massage roller assembly.
Figure 12:
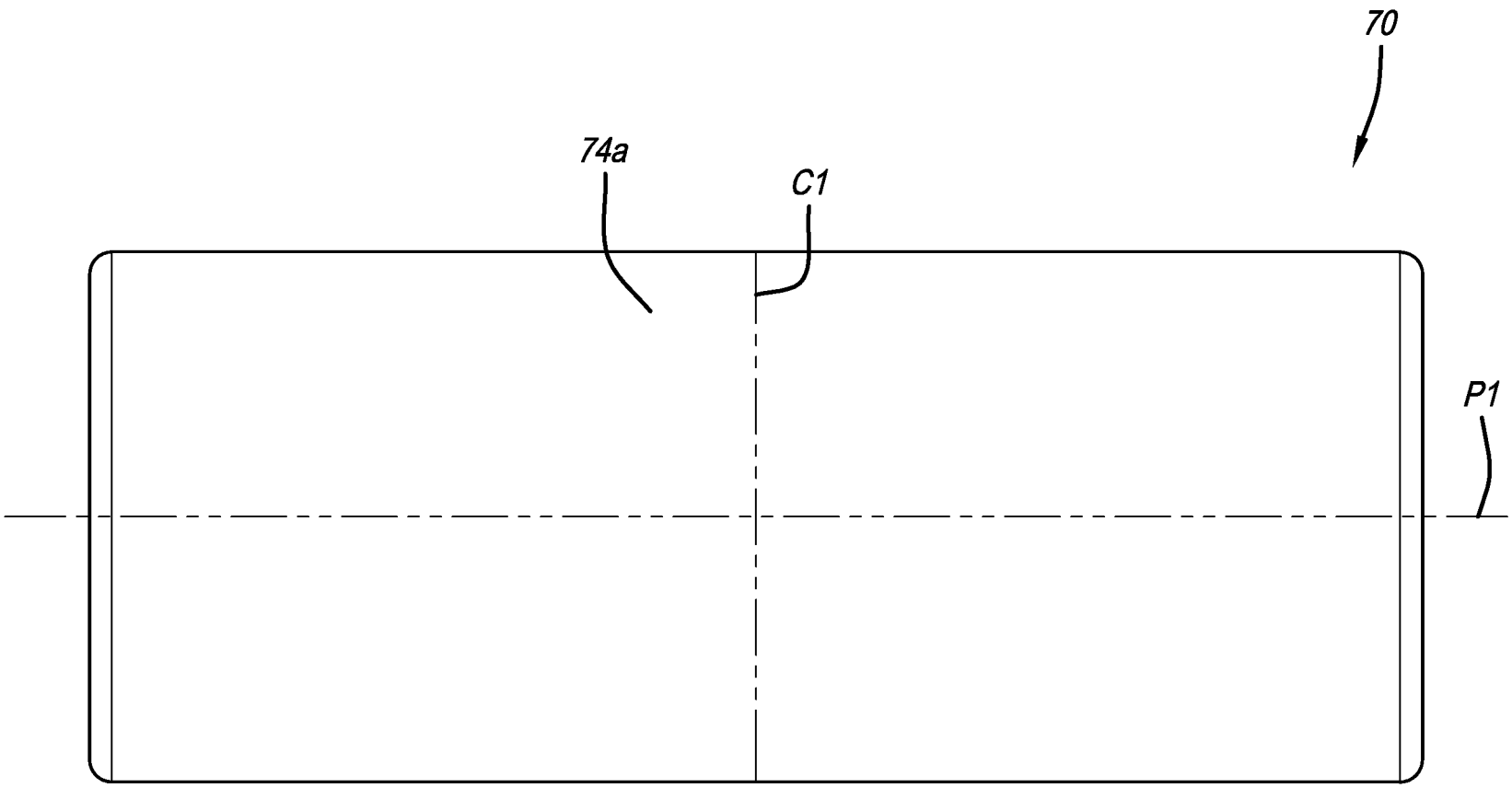
FIG. 12 is a side elevational view of the massage roller assembly.
Figure 13:
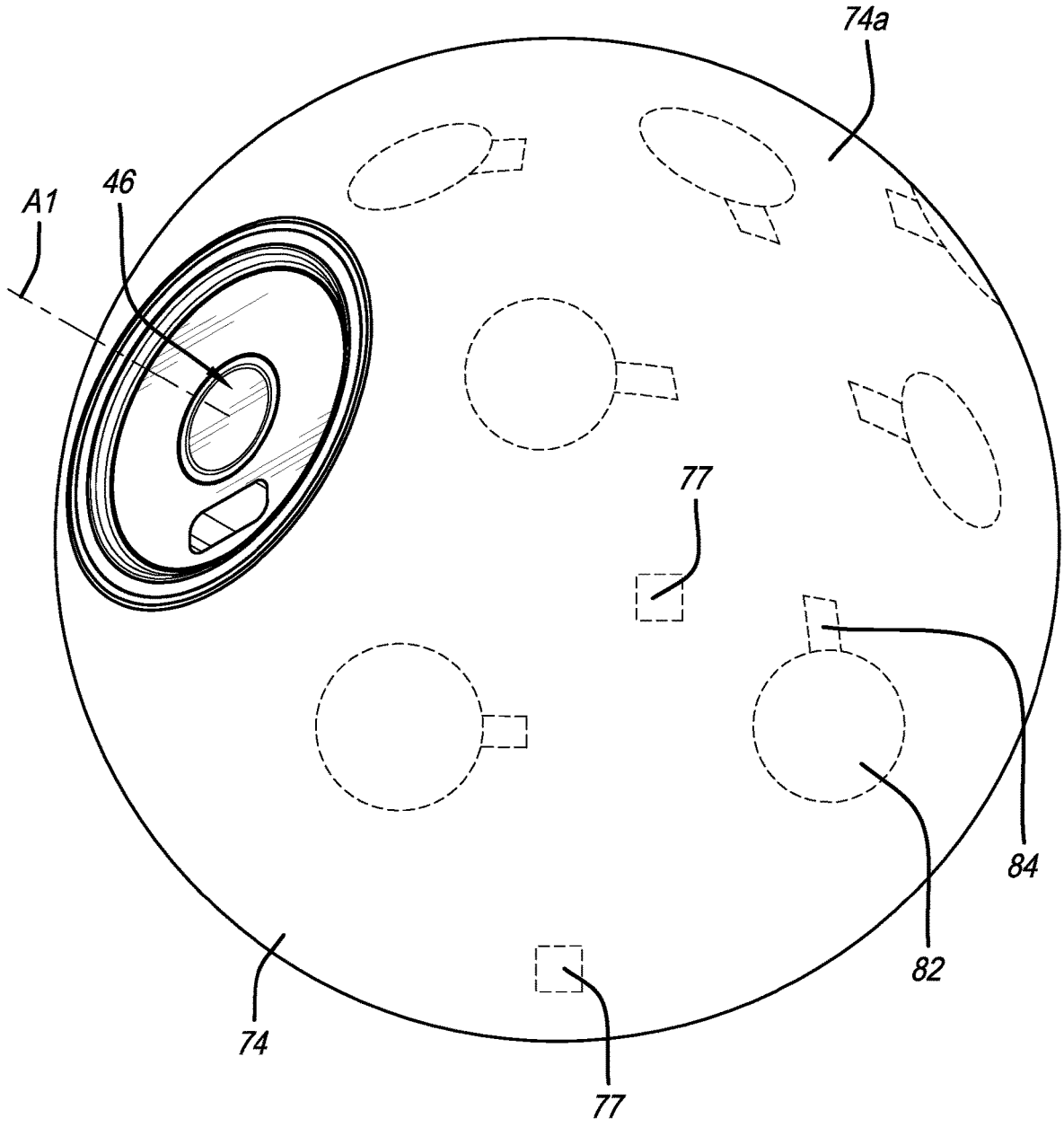
FIG. 13 is a perspective view of a spherical massage roller assembly in accordance with a preferred embodiment of the present invention.
Figure 14:
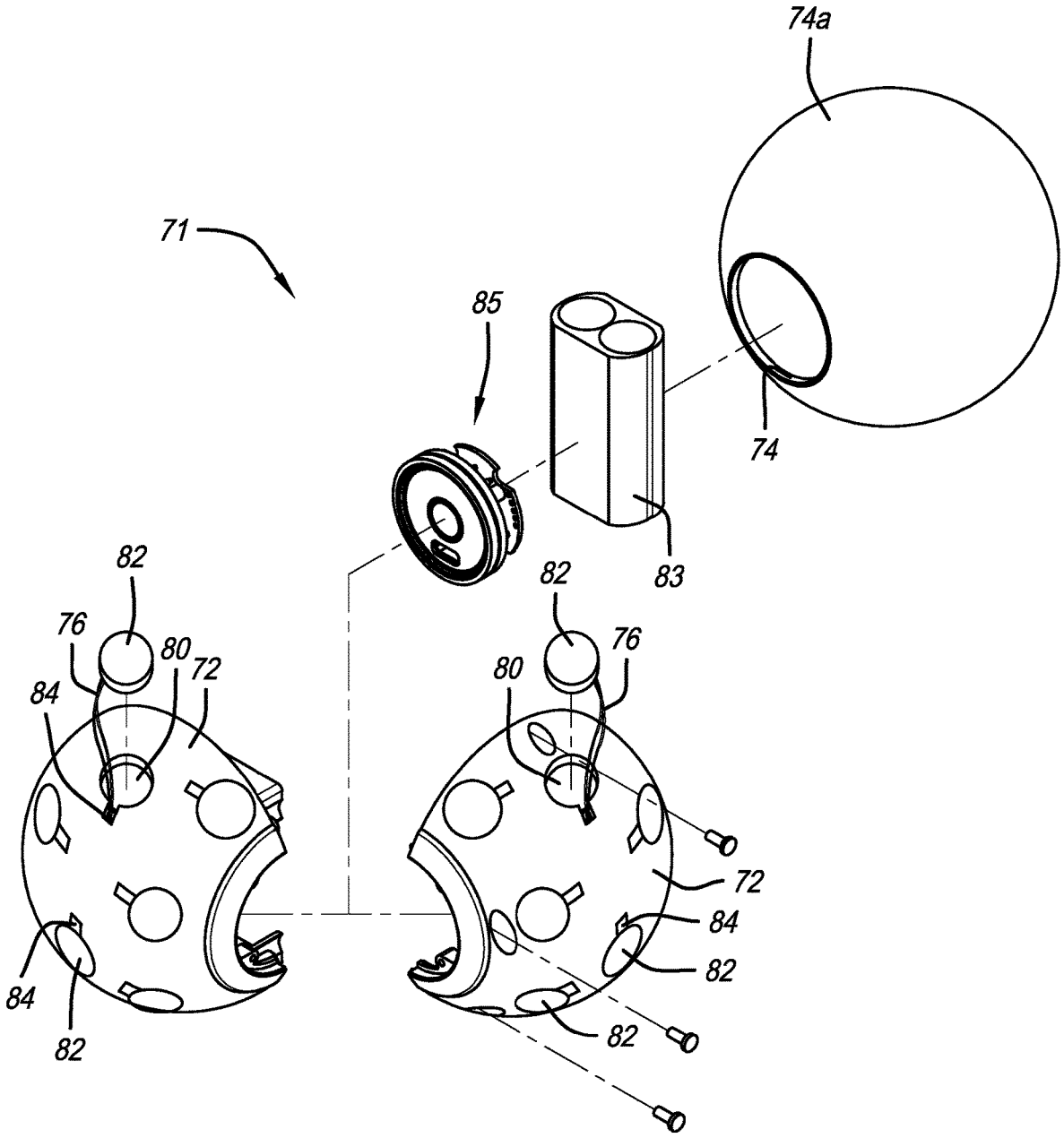
FIG. 14 is an exploded perspective view of the massage roller assembly.
Figure 15:
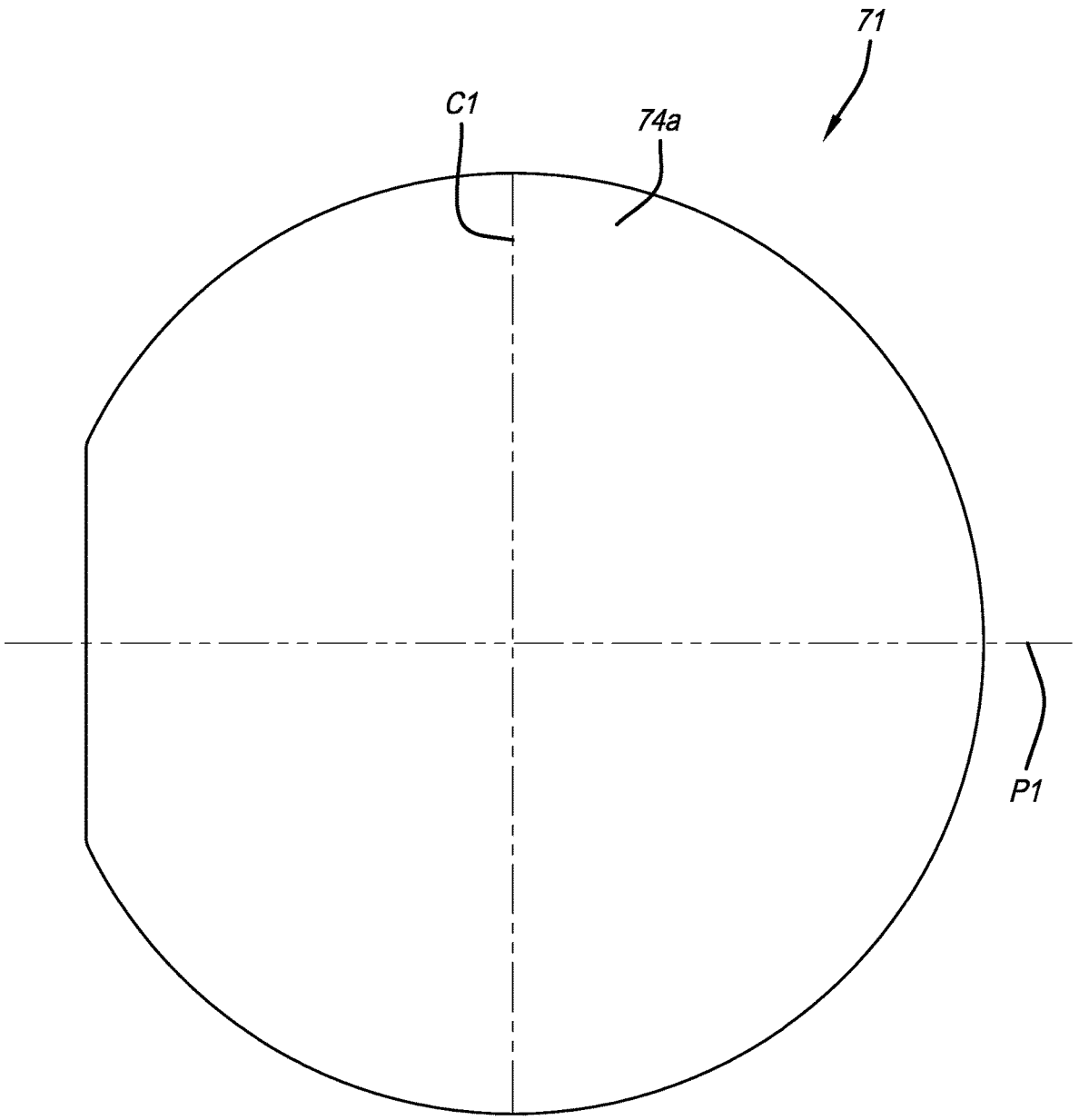
FIG. 15 is a side elevational view of the massage roller assembly.

FIGS. 9-15 show embodiments of two massage or vibrating roller assemblies that include multiple motors distributed around the massage roller assembly and that provide the ability to vibrate different sections or portions of the massage roller assembly. FIGS. 9-12 show a cylindrical massage roller assembly 70 and FIGS. 13-15 show a spherical massage roller assembly 71. It will be appreciated that other shapes are within the scope of the present invention. For example, see U.S. patent application Ser. No. 29/745,555, the entirety of which is incorporated by reference herein, and which shows a peanut shaped massage roller assembly.

As shown in FIGS. 9-12, the massage roller assembly 70 generally includes a cylindrical main body portion or shell 72 that defines a roller axis A1 and an outer cover 74 having an outer roller surface 74*a*. As shown in FIGS. 13-15, the massage roller assembly 71 generally includes a spherical main body portion or shell 72 that defines a roller axis A1 and an outer cover 74 having an outer roller surface 74*a*. All description related to the cylindrical roller assembly 70 is applicable to the spherical massage roller assembly 71 and vice versa. The shell 72 may be a single hollow piece (see FIG. 10) or may include separate halves or portions (see FIG. 14). The shell 72 preferably houses one or more batteries 78 for powering the device and the electronics of the device, which may include a controller, PCB, memory or other components for controlling and operating the device.

For example, the massage roller assembly 70 may include an electronics assembly 85 located at the end of the cylinder (see FIG. 1) or within the shell 72 and/or anywhere else in the massage roller assembly. See, e.g., exemplary control buttons 46. A display or screen (touch screen or non-touch screen) can also be included. The buttons can be used for on/off, changing speeds, connecting to Bluetooth, etc.). A charging and/or connecting port can also be included.

Figure 10:
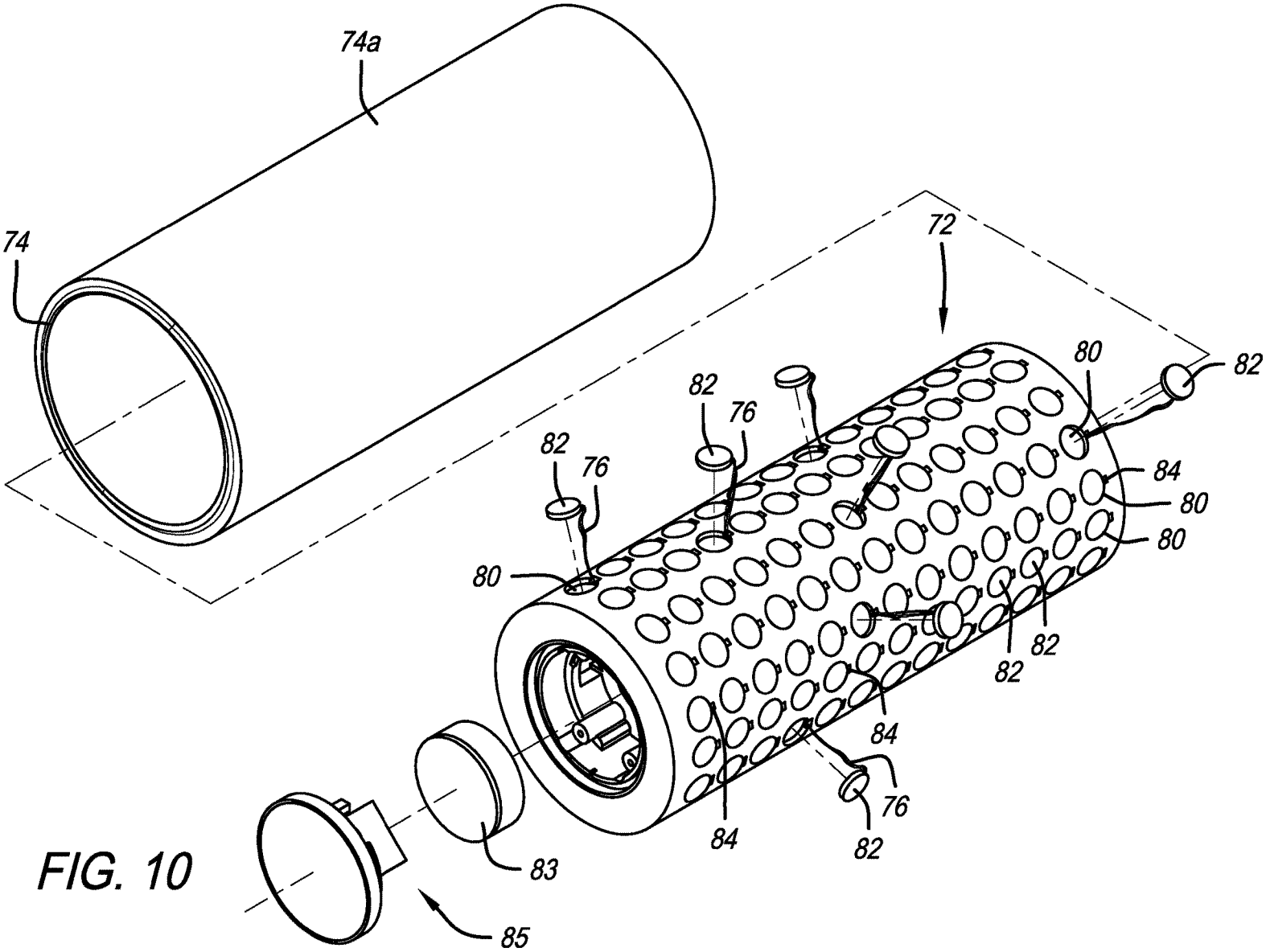
FIG. 10 is an exploded perspective view of the massage roller assembly.

As shown in FIG. 10, in a preferred embodiment, the shell 72 includes vibration motor recesses 80 that are configured to receive vibration motors 82. The vibration device recesses 80 may be open to the outside of the shell 72, as shown in FIGS. 10 and 14 or can be defined inside the shell 72. In a preferred embodiment, the vibration motors are puck shaped or type vibration devices or motors, such as is used in a cell phone. For example, preferably the entire vibration motor or device is included within the puck shaped housing. The puck shaped devices are small enough that a large number can be included in the device. E.g., between 4 and 500 vibration motors can be distributed throughout the massage roller assembly. The shell 72 preferably includes wire openings 84 defined therein for directing wires into the interior of the shell 72. FIGS. 10 and 14 show a number of the vibration motors 82 exploded from the shell 72 and shows the wires 76 exploded therewith, but extending into the wire openings 84. As shown in FIG. 11, if the inner shell or main body portion is thick, the wire openings 84 may be tunnels that extend into the interior to guide the wires to the appropriate location so that the vibration motors 82 are electrically and/or data communicated with the PCB, battery 83, electronics assembly 85, etc., as appropriate. The outer cover 74 surrounds and covers the shell 72 and vibration motors 82 for a user to roll on. The vibration motors 82 transmit vibrations to the outer cover 74.

Figure 9:
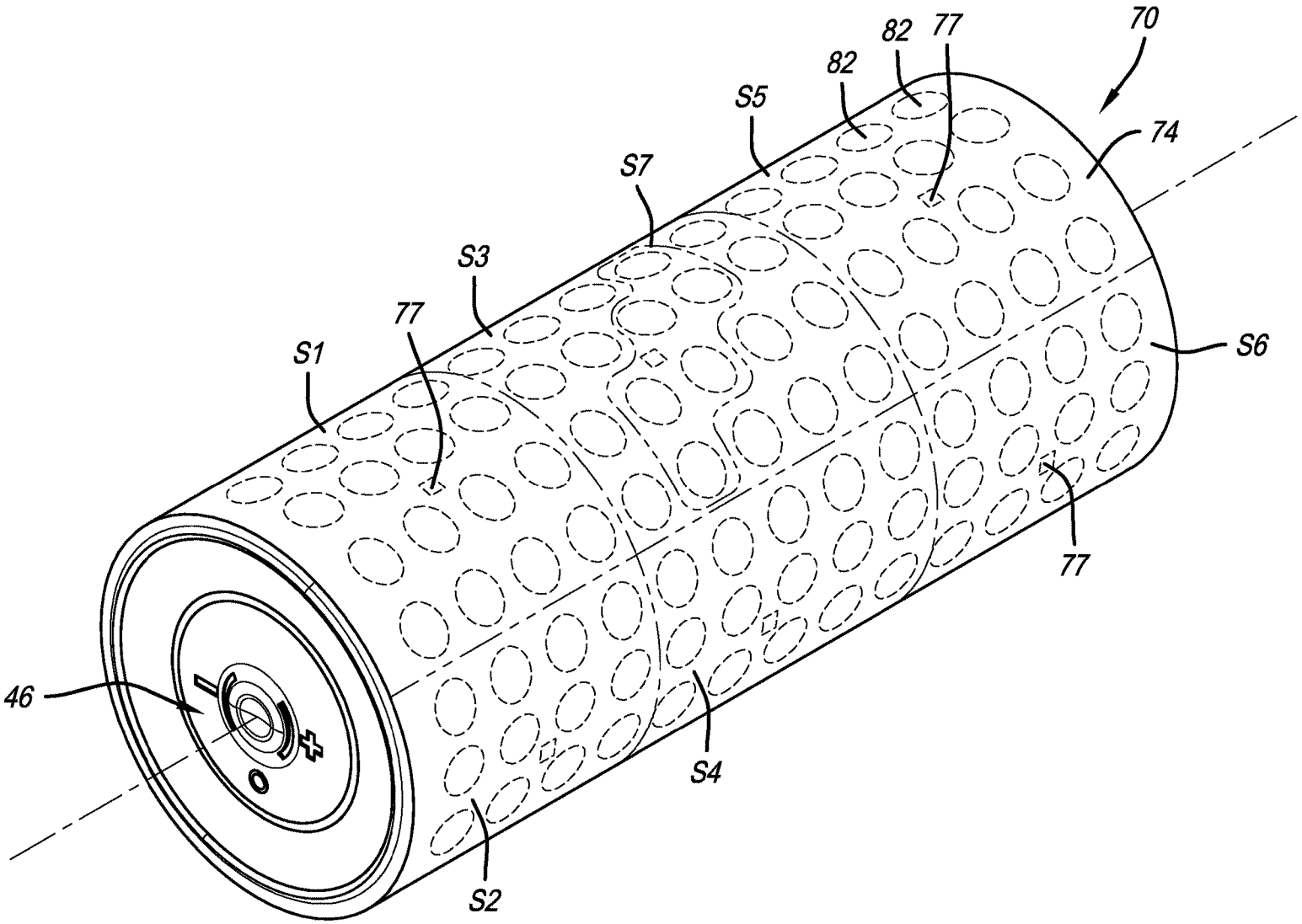
FIG. 9 is a perspective view of a cylindrical massage roller assembly in accordance with a preferred embodiment of the present invention.

In a preferred embodiment, the massage roller assembly 70 is configured to vibrate a section or portion of the outer surface of the massage roller assembly 70 or outer cover 74. The outer circumference or outer circumferential surface of the massage roller assembly 70 or outer cover 74 may include any number of sections (e.g., 1-100 or any number in between). Furthermore, the plurality of vibration motors 82 (shown in hidden lines in FIG. 9) can be grouped into any number of sets (a set can include from 1 to all vibration motors) that can be vibrated independently or as desired. FIG. 9 shows the portion of the massage roller assembly 70 or outer cover 74 that is visible divided into six separate sections, portions or sets, labeled S1 to S6 and divided by straight lines. Each of these sets S1 to S6 of vibration motors 82 can be vibrated separately or any number of them can be vibrated together. The electronics assembly can include the ability to cycle through different vibration patterns where certain one or more sets vibrate for a first period of time and then one or more different sets vibrate for a second period of time, etc.

In another embodiment, the massage roller assembly 70 is configured to sense the location of the user when the user is rolling on or placing their weight on the device. For example, the massage roller assembly 70 can include one or more sensors 77, positioned anywhere on or in the massage roller assembly, that sense the proximity of the user, the weight of the user, pressure or the like so that the location of the user on the massage roller assembly 70 or outer surface thereof can be determined. The outer cover or another layer of the massage roller assembly 70 can include a capacitive or other sensing layer that is configured to sense (via pressure, proximity, weight or the like) where the user is located. The sensors can also be or include one or more gyroscopes, accelerometers, etc. The set or sets of vibration motors 82 that the user is located on can then be vibrated, powered or turned on. For example, if the user is sensed to be located in section S1, the vibration devices in section or set S1 can vibrate and as the user rolls partially to section S2, both sets S1 and S2 can vibrate and as the user rolls completely to section S2, set S1 can be turned off while set S2 continues to vibrate.

FIG. 9 also includes a grouping or set of vibration motors 82 labeled S7 (six are shown in this example). This represents a set of six vibration motors 82 that the user is lying on. For example, the user may be lying on their hip area and over the six vibration devices in FIG. 9. In this example, only the exact vibration motors 82 that the user is overlying or touching (i.e., the outer cover over those vibration motors 82) are switched on. It will be appreciated that set S7 an exemplary set of vibration devices and that numerous combinations of vibration devices or sets of vibration devices are within the scope of the present invention.

As shown in FIGS. 9 and 13, in a preferred embodiment sets of vibration motors 82 are offset from circumferentially from one another about the massage roller assemblies. The sets can be circumferentially offset or positioned at any angle θ (from 1° to 359°) about the circular shape. FIG. 11 shows an exemplary angle θ. FIG. 12 shows a circle C1 about which sets of vibration motors can be positioned around the cylindrically shaped massage roller assembly 70 and FIG. 15 shows a circle C1 about which sets of vibration motors can be positioned around the spherically shaped massage roller assembly 71. It will be appreciated that the sphere forms other circles about which the vibration motors can be circumferentially offset from one another. As discussed above, a set can be any number of vibration motors, including one.

FIGS. 12 and 15 each show a side elevational view of the massage roller assembly 70 and massage roller assembly 71 that includes a plane P1 that represents a horizontal plane that remains horizontal when the devices roll during use. During use, the set of vibration motors above the plane P1 vibrate or are on and the set of vibration motors below the plane P1 do not vibrate or are off. This can be done to prevent the bottom vibration motors from vibrating the floor or ground and/or to save battery since the user is only rolling on the vibration motors at the top, upper portion or above the plane P1. In FIGS. 12 and 15, plane P1 bifurcates or is located in the center of the massage roller assembly such that the first set or upper set of vibration motors are the upper half and the second or lower set of vibration motors are the lower half. However, it will be appreciated that plane P1 can be moved upwardly or downwardly. For example, the first set or upper set of vibration motors may only be the top or a single strip of vibration motors and the second or lower set of vibration motors may be all others remaining. All these features combine to allow different sets of vibration motors to be turned on and off as desired whether the massage roller assembly is rolling or not.

Any method for determining when to turn the desired motors on and off is within the scope of the present invention. For example, proximity sensors (that sense when the subject portion of the vibrating roller is proximate to the user) can be used. Another embodiment can embody the idea of a compass where the needle always points north. In this embodiment, a component that always points or is directed up or down can be utilized. For example, the vibrating roller can include a hanging weight, mass or the like that can be disposed inside the inner shell. During rolling, due to gravity, the weight remains in the lower portion of the vibrating roller (i.e., it always "points" or hangs downwardly). As a result, it can be determined what portion of the vibrating roller is facing upwardly (and can be utilized by a person for rolling thereon) and what portion of the vibrating roller is facing downwardly. In turn, as the vibrating roller is rotated and used, the vibrating devices in the lower portion of the roller are switched off. Magnets or other types of sensors can be used to sense when the weight is in the lower half or keep the device in the lower portion, thus switching off the vibrating devices in the lower portion and switching on the vibrating devices in the upper portion at the desired time.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. Further, any specific numbers noted herein are only examples: alternative implementations may employ differing values, measurements or ranges.

Although the operations of any method(s) disclosed or described herein either explicitly or implicitly are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

The teachings of the disclosure provided herein can be applied to other systems, not necessarily the system described above. The elements and acts of the various embodiments described above can be combined to provide further embodiments. Any measurements or dimensions described or used herein are merely exemplary and not a limitation on the present invention. Other measurements or dimensions are within the scope of the invention.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

While certain aspects of the disclosure are presented below in certain claim forms, the inventors contemplate the various aspects of the disclosure in any number of claim forms. For example, while only one aspect of the disclosure is recited as a means-plus-function claim under 35 U.S.C. § 112, ¶6, other aspects may likewise be embodied as a means-plus-function claim, or in other forms, such as being embodied in a computer-readable medium. (Any claims intended to be treated under 35 U.S.C. § 112, ¶6 will include the words "means for"). Accordingly, the applicant reserves the right to add additional claims after filing the application to pursue such additional claim forms for other aspects of the disclosure.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A massage roller assembly, comprising:

an outer roller surface that defines a central axis;

a main body portion that includes the outer roller surface and has a plurality of vibration motor recesses defined therein;

a plurality of vibration motors positioned adjacent to the outer roller surface and configured to transmit vibrations to the outer roller surface, wherein each vibration motor in the plurality of vibration motors is disposed in one of the plurality of vibration motor recesses, and wherein the vibration motors are individually controllable such that at least first and second sets of vibration motors are configured to be switched on and off separately; and a controller configured to automatically switch on the first set when the first set is located above a horizontal plane defined relative to the main body portion, automatically switch on the second set when the second set is located above the horizontal plane, switch off the first set when the first set is below the horizontal plane, and switch off the second set when the second set is below the horizontal plane.

2. The massage roller assembly of claim 1, further comprising an outer cover, wherein the outer cover covers the plurality of vibration motors.

3. The massage roller assembly of claim 1, further comprising at least a first sensor configured to sense a position of a user on the outer roller surface.

4. The massage roller assembly of claim 1, comprising a cylindrical shape.

5. The massage roller assembly of claim 1, comprising a spherical shape.

6. The massage roller assembly of claim 1, comprising a gyroscope configured to determine a position of the massage roller assembly, wherein the controller is configured to switch on and switch off motors among the plurality of vibration motors in response to the position determined by the gyroscope.

7. A method of using a massage roller assembly that includes an outer roller surface and a plurality of vibration motors positioned adjacent to the outer roller surface, wherein the plurality of vibration motors form at least first and second sets of vibration motors, wherein the massage roller assembly defines a circular shape, wherein the second set of vibration motors are positioned at a location circumferentially offset from the first set of vibration motors, and wherein the massage roller assembly defines a horizontal plane that remains horizontal when the massage roller assembly rolls, the method comprising the steps of:

placing the massage roller assembly on a floor at a first position;

switching on the first set of vibration motors, wherein the first set of vibration motors are located above the horizontal plane and the second set of vibration motors are located below the horizontal plane;

rolling the massage roller assembly on the floor from the first position to a second position;

switching off the first set of vibration motors when the massage roller assembly is in the second position; and switching on the second set of vibration motors, wherein the second set of vibration motors are located above the horizontal plane and the first set of vibration motors are located below the horizontal plane.

8. The method of claim 7, wherein the massage roller assembly includes a main body portion and an outer cover, wherein the main body portion includes a plurality of vibration motor recesses defined therein, wherein each vibration motor recess includes one of the plurality of vibration motors therein, and wherein the outer cover covers the plurality of vibration motors.

9. The method of claim 7, wherein the massage roller assembly includes at least a first sensor configured to sense a position of a user on the outer roller surface.

10. The method of claim 7, wherein the massage roller assembly comprises a cylindrical shape.

11. The method of claim 7, wherein the massage roller assembly comprises a spherical shape.

12. A massage roller assembly, comprising:

a main body portion that includes an outer roller surface and defines a central axis;

a controller located in the main body portion;

a gyroscope configured to detect a position of the massage roller assembly; and a plurality of vibration motors positioned about the central axis and configured to transmit vibrations to the outer roller surface, wherein the plurality of vibration motors includes at least first and second sets of vibration motors, the second set of vibration motors is circumferentially offset from the first set of vibration motors about the central axis, and the vibration motors are controllable such that the first and second sets of vibration motors are configured to be switched on and off separately, wherein the controller is configured to:

switch on the first set of vibration motors when the massage roller assembly is in a first position wherein the first set of vibration motors are located on a first side of a plane defined by the massage roller assembly and the second set of vibration motors are located on a second side of the plane, the second side being opposite from the first side, wherein the angular position of the plane remains the same when the massage roller assembly rolls; and switch on the second set of vibration motors when the massage roller assembly is in a second position wherein the second set of vibration motors are located on the first side of the plane and the first set of vibration motors are located on the second side of the plane.

13. The massage roller assembly of claim 12, wherein the controller is configured to:

switch off the second set of vibration motors when the vibration roller assembly is in the first position; and switch off the first set of vibration motors when the vibration roller assembly is in the second position.

14. The massage roller assembly of claim 13, wherein the plane is a horizontal plane.

15. The massage roller assembly of claim 14, wherein the first side is above the horizontal plane and the second side is below the horizontal plane.

16. The massage roller assembly of claim 15, wherein the massage roller assembly is configured to roll on a flat surface between the first position and the second position.

* * * * *